US012221721B2

(12) United States Patent
Iqbal et al.

(10) Patent No.: US 12,221,721 B2
(45) Date of Patent: Feb. 11, 2025

(54) ELECTROSPUN RADIATIVE COOLING TEXTILE

(71) Applicant: City University of Hong Kong, Kowloon (HK)

(72) Inventors: Mohammad Irfan Iqbal, Kowloon (HK); Kaixin Lin, Kowloon (HK); Hau Him Lee, New Territories (HK); Chi Yan Tso, Tsuen Wan (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 17/886,740

(22) Filed: Aug. 12, 2022

(65) Prior Publication Data

US 2024/0052525 A1 Feb. 15, 2024

(51) Int. Cl.
*D01D 5/00* (2006.01)

(52) U.S. Cl.
CPC ..... *D01D 5/0038* (2013.01); *D10B 2321/021* (2013.01)

(58) Field of Classification Search
CPC .... D01D 5/0053; D01D 5/003; D01D 5/0038; D10B 2321/21
See application file for complete search history.

(56) References Cited

U.S. PATENT DOCUMENTS 9,180,412 B2 * 11/2015 Jo ..... H01M 50/44
10,188,973 B2 * 1/2019 Clayton ..... B01D 39/00
2003/0056883 A1 * 3/2003 Bansal ..... D01D 5/30 156/181
2006/0160064 A1 * 7/2006 Carbonell ..... B01J 20/3219 435/5
2007/0116640 A1 * 5/2007 Kim ..... D01F 9/08 977/932
2010/0003519 A1 * 1/2010 Chen ..... B82Y 30/00 428/401
2010/0009267 A1 * 1/2010 Chase ..... C04B 35/62259 204/192.12
2010/0292662 A1 * 11/2010 Matsubara ..... D04H 3/147 428/374
2010/0317249 A1 * 12/2010 Clark ..... D04H 1/43838 442/341

(Continued)

OTHER PUBLICATIONS

Science sciencemag.org; Nov. 13, 2020 • vol. 370 Issue 6518; E. Pennisi.

(Continued)

*Primary Examiner* — Emmanuel S Luk
(74) *Attorney, Agent, or Firm* — Renner, Kenner, Greive, Bobak, Taylor & Weber

(57) ABSTRACT

A radiative cooling apparatus including a layer of a material. The layer defines an exterior face. The material has a composition such that the layer is configured to reflect, at the exterior face, at least partly of the incoming electromagnetic radiation of at least some wavelengths in the solar spectrum. The layer is further configured to emit thermally-generated electromagnetic emission of at least some mid-infrared wavelengths out from the exterior face. Ceramics provided by embodiments of the invention could produce extra cooling effect without any electricity consumption, creating a prominent benefit to the energy saving of air conditioning systems of buildings.

13 Claims, 17 Drawing Sheets

(56) References Cited

U.S. PATENT DOCUMENTS

| | | | | |
|---|---|---|---|---|
| 2012/0114722 | A1* | 5/2012 | Ballard | A01N 59/02 977/788 |
| 2014/0039434 | A1* | 2/2014 | Xu | A61F 13/538 604/367 |
| 2014/0120448 | A1* | 5/2014 | Mori | H01M 8/1041 429/479 |
| 2015/0045454 | A1* | 2/2015 | Kong | D01F 1/10 106/206.1 |
| 2015/0221916 | A1* | 8/2015 | Lee | H01M 10/0525 429/254 |
| 2015/0270522 | A1* | 9/2015 | Yamada | H01M 50/44 429/145 |
| 2017/0110735 | A1* | 4/2017 | Ito | D01F 9/21 |
| 2018/0177687 | A1* | 6/2018 | Seo | A45D 44/22 |
| 2019/0008217 | A1 | 1/2019 | Cui et al. | |
| 2019/0143254 | A1* | 5/2019 | Zhang | B01D 46/71 264/465 |
| 2019/0239586 | A1 | 8/2019 | Cui et al. | |
| 2020/0274201 | A1* | 8/2020 | Kumta | H01M 4/1395 |
| 2022/0042206 | A1* | 2/2022 | Tong | B05D 1/007 |

OTHER PUBLICATIONS

Nature Sust ainability | www.nature.com/natsustain; Brief Communication https://doi.org/10.1038/s41893-019-0441-9; Heat exposure and global air conditioning Leopold T. Biardeau et al, 2019.

Adv. Funct. Mater. 2020, 30, 2005033; © 2020 Wiley-VCH GmbH; Wool Can Be Cool: Water-Actuating Woolen Knitwear for Both Hot and Cold; J. Hu et al.

https://doi.org/10.1021/acsami.1c16323 ACS Appl. Mater. Interfaces 2021, 13, 54386-54395; Hierarchically Structured and Scalable Artificial Muscles for Smart Textiles; Y.Peng et al.

https://dx.doi.org/10.1021/acsami.0c20868; ACS Appl. Mater. Interfaces 2021, 13, 6298-6308; Knit Architecture for Water-Actuating Woolen Knitwear and Its Personalized Thermal Management; M. Iqbal et al.

Adv. Mater. 2007, 19, 3702-3706; Fabrication of Aligned Fibrous Arrays by Magnetic Electrospinning; D. Yang et al.

Polymers May 2013, 19-44; doi: 10.3390/polym5010019; Hierarchically Structured Electrospun Fibers; N. Zander.

Materials Science & Engineering R 146 (2021) 100639; https://doi.org/10.1016/j.mser.2021.100639; Advanced materials for personal thermal and moisture management of health care workers wearing PPE; L. Lou et al.

Joule 4, 724-742, Apr. 15, 2020; Advanced Textiles for Personal Thermal Management and Energy; Y. Peng et al.

Nature Nanotechnology | vol. 16 | Feb. 2021 | 153-158 | www.nature.com/naturenanot; Scalable and hierarchically designed polymer film as a selective thermal emitter for high-performance all-day radiative cooling; D. Li.

https://dx.doi.org/10.1021/acsami.0c09374; ACS Appl. Mater. Interfaces Dec. 2020, 43553-43559; Selectively Enhancing Solar Scattering for Direct Radiative Cooling through Control of Polymer Nanofiber MorphologyH. Kim et al.

https://doi.org/10.1021/acs.nanolett.1c03801; Nano Lett. 2022, 22, 680-687; Integration of Janus Wettability and Heat Conduction in Hierarchically Designed Textiles for All-Day Personal Radiative Cooling D. Miao et al.

https://doi.org/10.1016/j.cej.2018.08.189 Received Jun. 21, 2018; Received in revised form Jul. 17, 2018; Accepted Aug. 27, 2018 Chemical Engineering Journal 355 (2019) 532-539 Available online Aug. 28, 2018 1385-8947/; Y. Lu et al.

https://doi.org/10.1016/j.nanoen.2020.105695; Received in revised form Nov. 17, 2020; Accepted Dec. 10, 2020;Single electrode piezoelectric nanogenerator for intelligent passive daytime radiative cooling; W. Song et al.

Hsu et al., Sci. Adv. 2017;3: e1700895 Nov. 10, 2017.

Sciencemag.org Science; Nov. 13, 2020 • vol. 370 Issue 6518; Published by AAAS; Photonengineered radiative cooling textiles Personal thermal management offers a path to reduce climate control energy use; P. Hsu et al.

https://doi.org/10.1021/acsnano.1c08227; ACS Nano 2022, 16, 2188-2197; A Moisture-Wicking Passive Radiative Cooling Hierarchical Metafabric; X. Zhang et al.

https://doi.org/10.1016/j.apenergy.2018.12.018; Received in revised form Nov. 28, 2018; Accepted Dec. 4, 2018; Applied Energy 236 (2019) 489-513; Available online Dec. 10, 2018; 0306-2619/; Radiative cooling: A review of fundamentals, materials, applications, and prospects; B. Zhao et al.

5 4 0 | Nature | vol. 5 1 5 | Nov. 27, 2014; doi: 10.1038/nature13883; Passive radiative cooling below ambient air temperature under direct sunlight; A. Raman et al.

Sep. 2, 2016 • vol. 353 Issue 6303; sciencemag.org; Radiative human body cooling by nanoporous polyethylene textile; P. Hsu et al.

DOI: 10.1021/acs.nanolett.7b00579; Nano Lett. 2017, 17, 3506-3510; Thermal Management in Nanofiber-Based Face Mask; A. Yang.

ACS Appl. Mater. Interfaces Oct. 2018, 41637-41644 www.acsami.org; Wearable Polyethylene/Polyamide Composite Fabric for Passive Human Body Cooling; Y. Song et al.

Macromol. Mater. Eng. 2018, 303, 1700456; DOI: 10.1002/mame.201700456; www.mme-journal.de; A Novel Approach to Design Nanoporous Polyethylene/Polyester Composite Fabric via TIPS for Human Body CoolingR. Liu et al.

DOI: 10.1002/adma.201802152; Adv. Mater. 2018, 30, 1802152; www.advmat.de; Spectrally Selective Nanocomposite Textile for Outdoor Personal Cooling; L. Cai et al.

Cooling Textiles; Hierarchical-morphology metafabric for scalable passive daytime radiative coolingZeng et al., Science 373, 692-696 (2021) Aug. 6, 2021.

ACS Publications; DOI: 10.1021/acsami.6b08262 ACS Appl. Mater. Interfaces Aug. 2016, 23985-23994; Electret Polyvinylidene Fluoride Nanofibers Hybridized by Polytetrafluoroethylene Nanoparticles for High-Efficiency Air Filtration; S. Wang et al.

Journal of Applied Polymer Science, vol. 77, 3099-3106 (2000); accepted May 18, 1999; Refractive Index Profile of Polyethylene Fiber Using Interactive Multiple-Beam Fizeau Fringe Analysis; A. Hamza et al.

Journal of Applied Physics 36, 1674 (1965); https://doi.org/10.1063/1.1703106 Submitted: Nov. 2, 1964 • Published Online: Jul. 14, 2004; Measurement of the Refractive Indices of Several Crystals; W. Bond.

Journal of Applied Physics 83, 5447 (1998); https://doi.org/10.1063/1.367375 Submitted: Dec. 12, 1997 • Accepted: Feb. 17, 1998 • Published Online: Apr. 28, 1998; On the optical band gap of zinc oxide; V. Srikant et al.

Journal homepage: www.elsevier.com/locate/ceramint; http://dx.doi.org/10.1016/j.ceramint.2017.04.067; Received in revised form Mar. 25, 2017; Accepted Apr. 11, 2017; ZnO nanostructures decorated hollow glass microspheres as near infrared reflective pigment; D. Lu et al.

E3S W eb of C onferences 172, 03006 ( 2020) NSB 2020; http://doi.org/10.1051/e3sconf/202017203006;NIR reflective pigments to mitigate the urban heat islands effect (UHIE); A. Rosati et al.

https://dx.doi.org/10.1021/acs.iecr.0c01178; Ind. Eng. Chem. Res. 2020, 59, 15226-15232; pubs.acs.org/IECR; Keep Cool: Polyhedral ZnO@ZIF-8 Polymer Coatings for Daytime Radiative Cooling; H. Kang et al.

ACS Appl. Mater. Interfaces Nov. 2019, 44673-44681; Infrared-Radiation-Enhanced Nanofiber Membrane for Sky Radiative Cooling of the Human Body; R. Xiao et al.

Indian Journal of Fibre & Textile Research vol. 40, Jun. 2015, pp. 162-169; Liquid transfer properties and drying behavior of plated knitted fabrics with varying fibre types; Y. Jhanji et al.

Adv. Funct. Mater. 2022, 32, 2200961; https://doi.org/10.1002/adfm.202200961.; Bioinspired Perspiration-Wicking Electronic Skins for Comfortable and Reliable Multimodal Health Monitoring; Y. Xu.

Smart hydrophobic and soil repellent protective composite coatings for textiles and leather; B. Mahltig; Niederrhein University of Applied Sciences, Faculty of Textile and Clothing Technology, Webschulstraße 31, 41065 Monchengladbach, Germany 2016.

(56) References Cited

OTHER PUBLICATIONS

Nanoscale, Jul. 2015, 16899; Thermal conductivity of electrospun polyethylene; J. Ma et al.
Revised Dec. 24, 2006; accepted Jan. 4, 2007; DOI: 10.1002/polb.21122 Published online in Wiley InterScience (www.interscience.wiley.com). Electrospinning of Ultrahigh-Molecular-Weight Polyethylene Nanofibers; D. Rein et al.
Macromolecules, vol. 40, No. 3, 608-610 2007; Electrospinning of Polyethylene Microfibers; High-Temperature Electrospinning of Polyethylene Microfibers from Solution; S. Givens et al.
ImageJ, U.S. National Institutes of Health, Bethesda, Maryland, USA | CiNii Research; http://imagej.nih.gov/ij/http://imagej.nih.gov/ij/ 2011; Method of Measuring Modulation Transfer Function in Computed Tomography Using Slit Method with AirGap Phantom; U. Tomoyuki et al.

* cited by examiner

ELECTROSPUN RADIATIVE COOLING TEXTILE

FIELD OF INVENTION

This invention relates to non-woven fabrics, and in particular to passive radiative cooling textiles.

BACKGROUND OF INVENTION

As the average world temperature rises, individuals will be exposed to increasingly frequent and severe heat waves in hot, moist, and sunny environments, increasing the risk of heat exhaustion and other heat-related illnesses. To ensure that individuals remain comfortable and safe in a sustainable and robust society with better energy efficiency, a wearable personalized cooling system, which regulates the localized heat transfer all around the human body rather than the entire environment, is immediately required. Personal cooling technology is predicted to enhance the heat tolerance of individuals, enabling them to work or exercise more efficiently for extended periods in extreme temperatures.

A radiative heat-engineered cooling textile is a therefore promising way of personal thermal management that is gaining popularity day-by-day. This technology aims to scatter/reflect solar radiation and effectively transmit mid-infrared radiation to minimize the body temperature rise for spontaneous personal cooling to occur. However, there are some drawbacks associated with traditional passive radiative cooling textiles which are difficult to overcome, including unsatisfactory cooling power, unsuitable or expensive for large-scale production, oxidative decomposition, and complex, inefficient manufacturing method which are time-consuming and high-energy-consuming.

SUMMARY OF INVENTION

Accordingly, the present invention, in one aspect, is a method for manufacturing a radiative cooling textile. The method contains the steps of providing an organic solution containing a polymer; adding a metal oxide into the organic solution to form a suspension; electrospinning the suspension on a substrate; and performing a heat-pressing treatment to electrospun fabric.

In some embodiments, the step electrospinning the suspension includes the steps of feeding the suspension into a syringe, and spinning the suspension by a syringe pump at a spinning voltage.

In some embodiments, the spinning voltage is in the range of 15-30 kV.

In some embodiments, the spinning voltage is 25 kV.

In some embodiments, the method includes the step of drying the electrospun fabric before the step of performing the heat-pressing treatment.

In some embodiments, the step of providing an organic solution containing a polymer, further includes dissolving the polymer in the organic solution, and then stirring the organic solution using a magnetic stirrer.

In some embodiments, after the step of adding a metal oxide into the organic solution, the method further includes the step of stirring the suspension until particles of the metal oxide are evenly dispersed without obvious agglomeration.

In some embodiments, the substrate is an aluminum foil.

In some embodiments, in the step of performing the heat-pressing treatment, applied pressure, temperature and time are 0.14 MPa, 105° C. and 30 minutes, respectively.

In some embodiments, in the step of performing the heat-pressing treatment, the heat-pressing is conducted in two sides of the electrospun fabric.

In some embodiments, the metal oxide is reflective and the polymer is thermoplastic.

In some embodiments, the metal oxide is zinc oxide and the polymer is polyethylene.

Embodiments of the invention therefore provide a nano-fabric with excellent optical properties and applicability. The nano-fabric offers a cool fibrous structure with outstanding solar reflectivity (e.g., 91%) and mid-infrared transmissivity (e.g., 81%). The nano-fabric can completely release the human body from unwanted heat stress in most conditions via radiative cooling during nighttime and daytime, providing an additional cooling effect as well as demonstrating world-wide feasibility. Even in some extreme conditions, the nano-fabric can reduce the human body's cooling demand compared with traditional cotton textile, proving this material as a feasible solution for better thermoregulation of the human body.

Because the textile can be used effectively for cooling, it is suitable for garment production to enhance the heat dissipation, to achieve temperature reduction of the skin surface. Thus, the energy consumption for air conditioning systems for personal cooling can be saved. In this case, this technology can be beneficial to mitigate greenhouse gases emission, and the urban heat island effect. The textile is a smart comfort textile, because spectrally selective textiles can intelligently regulate the outdoor and indoor thermal and light environment for human body thermal comfort management. Spectrally selective textile can automatically save building energy at different temperatures, and its flexibility allows easy design as different aesthetic pattern in building decoration area.

The foregoing summary is neither intended to define the invention of the application, which is measured by the claims, nor is it intended to be limiting as to the scope of the invention in any way.

BRIEF DESCRIPTION OF FIGURES

The foregoing and further features of the present invention will be apparent from the following description of embodiments which are provided by way of example only in connection with the accompanying figures, of which.

DETAILED DESCRIPTION

Figure 1:
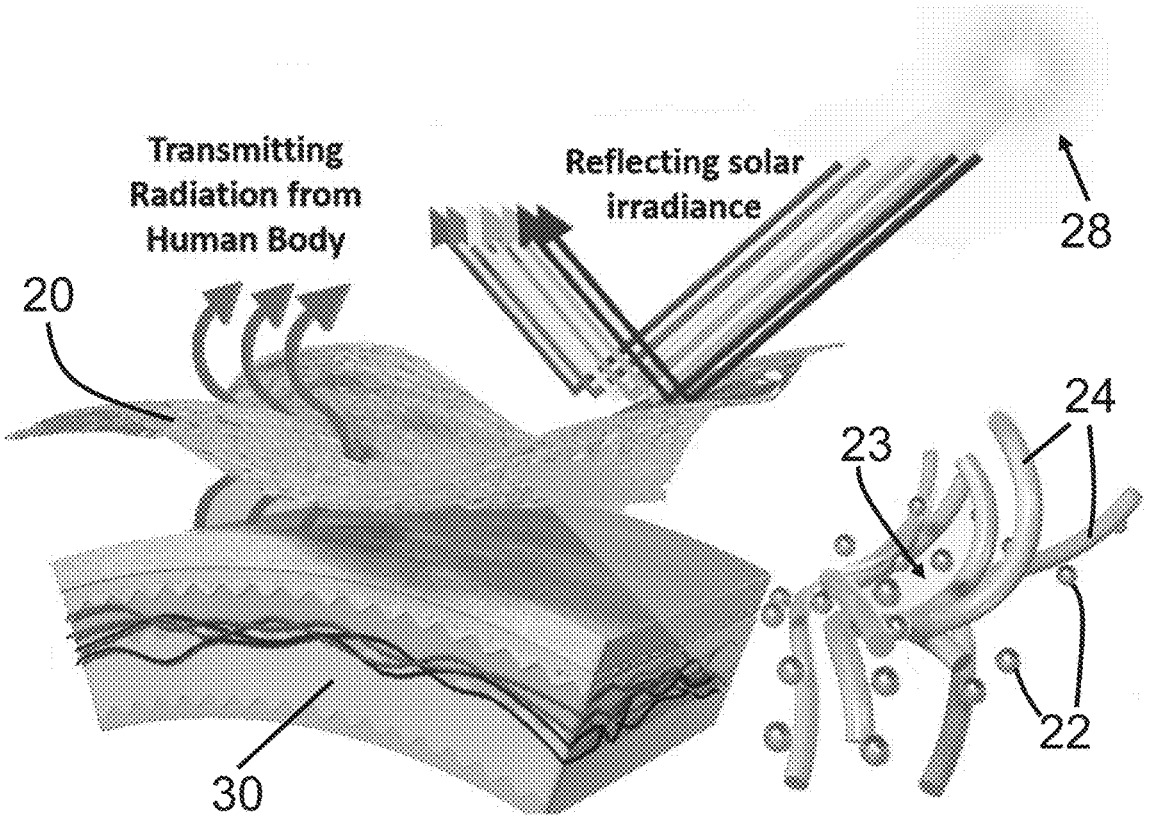
FIG. 1 is an illustration of a Radiative Cooling NanoFabric (RCNF) including a micro-level image, and its working principle according to a first embodiment of the invention.

Refer to FIG. 1, in which an efficient RCNF 20 using highly spectrally selective functional materials made by a facile electrospinning process is illustrated. The main components of the RCNF 20 are low solar absorptive zinc oxide (ZnO) incorporated with highly mid-infrared transparent polyethylene (PE) fibers 24 containing numerous nanopores 23, and ZnO nanoparticles 22 randomly distributed across their surfaces. The high mid-infrared transmissivity of PE polymer can allow the thermal radiation emitted by the human body (in particular, skin 30) to pass through, which helps the human body to reduce its temperature. Furthermore, the RCNF 20 as it is created by electrospinning technology has a disordered porous structure and is full of fibre-air interfaces, which effectively scatter solar irradiance such as visible light from the sun 28, and at the same time transmit mid-infrared light from the human body to the atmosphere.

Figure 2:
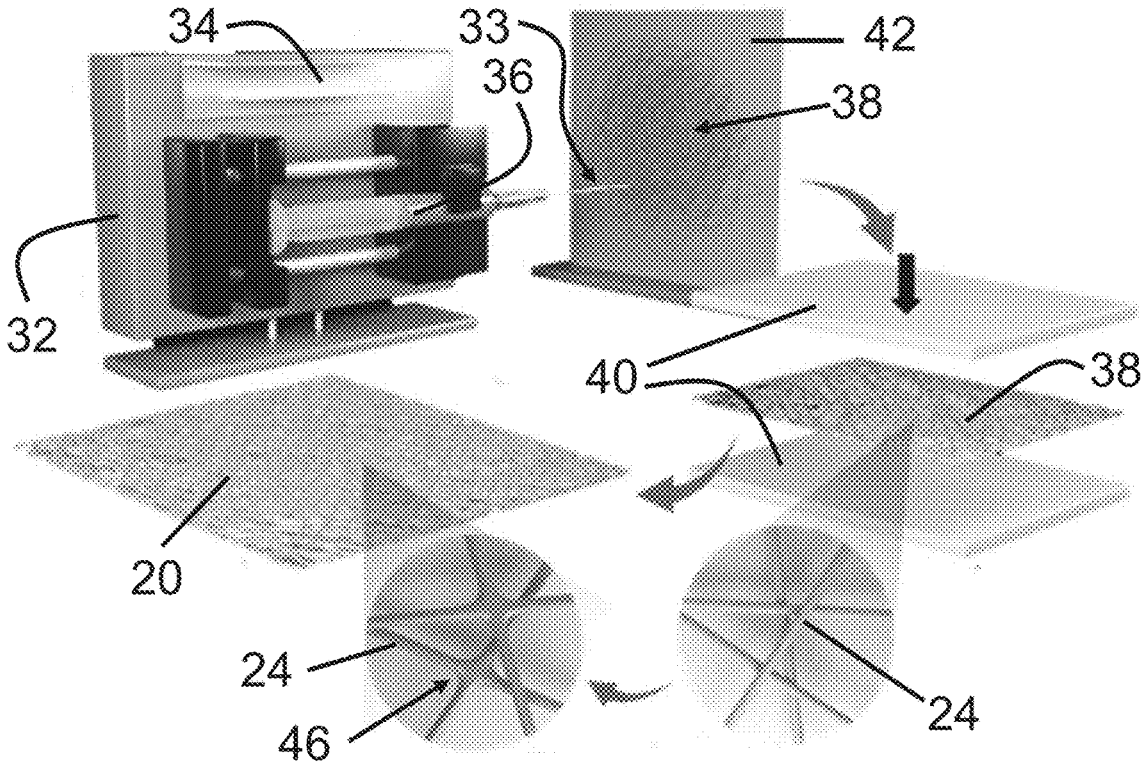
FIG. 2 is a schematic illustration of a method of preparing a RCNF according to another embodiment of the invention.
Figure 3:
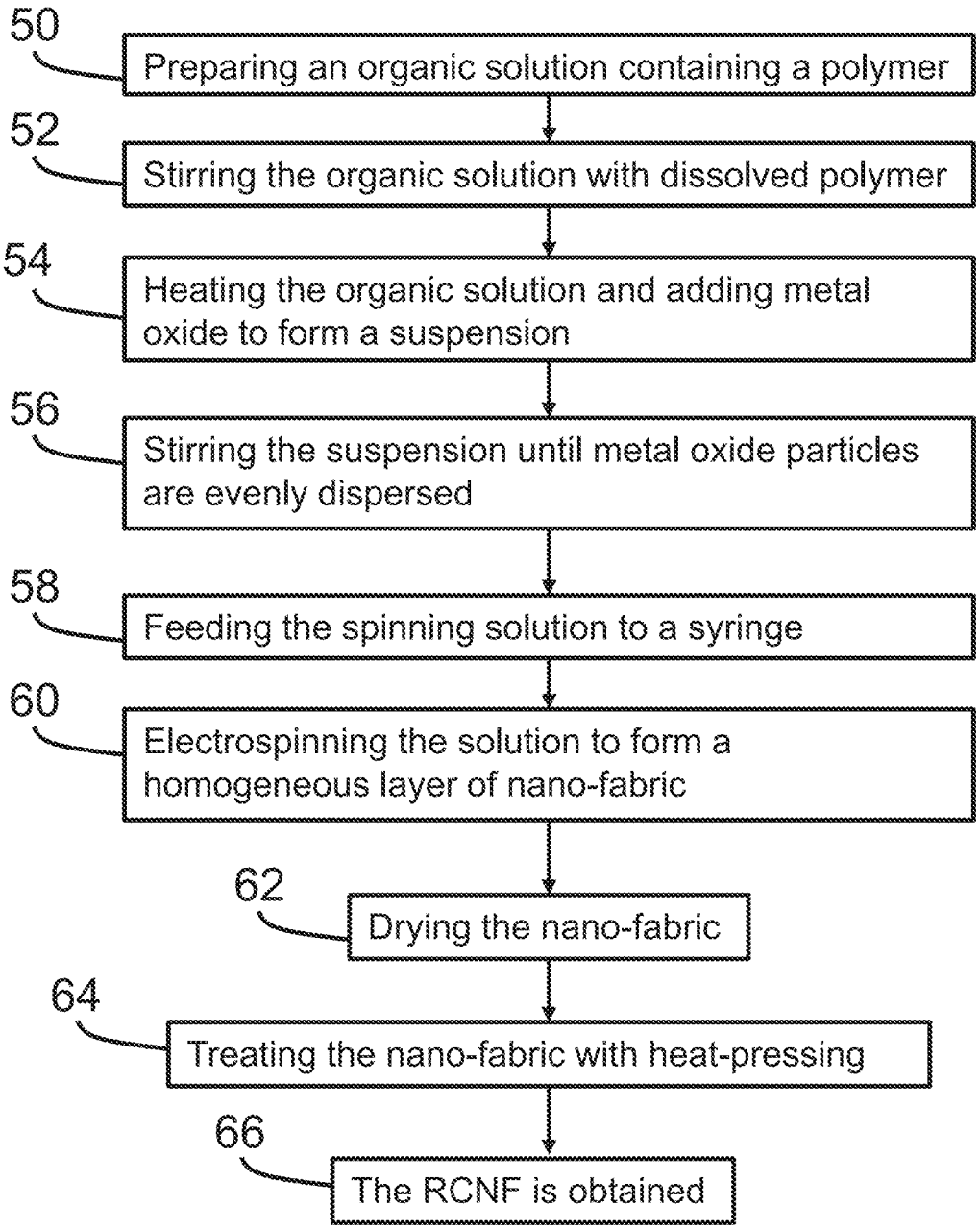
FIG. 3 is a flowchart showing main steps of the method in FIG. 2.

One exemplary manufacturing method of the RCNF 20 is now described with references to FIGS. 2-3. It should be noted that the method described below is not the only method to manufacture the RCNF 20. Rather, variations are allowed in the method such as the specific parameters like voltage, time and temperature, choices of raw materials, equipment used, etc. The method starts in Step 50, in which 10 wt % HDPE (High-Density polyethylene) as a polymer is mixed in a p-xylene solution (which is an organic solution) to dissolve HDPE. p-xylene is a solvent that is widely used in the production of PE. The electrical conductivity of p-xylene, on the other hand, is extremely low, with a value of around 3 pS/m. The dielectric constant of p-xylene is also just about 2.4, which is not particularly high. To increase the electrical conductivity and dielectric constant of the solution, cyclohexanone is added to p-xylene at a weight ratio of 1:1. The organic solution is then stirred using a magnetic stirrer (not shown) in Step 52, till a homogeneous transparent solution is formed. Next, in Step 54 the PE-ZnO solution is made by heating the solvent combination to 120° C. and then adding ZnO nanoparticles 22 with a weight ratio of ZnO:PE=1:2. In Step 56, the PE-ZnO solution is again agitated until the PE pellets are entirely dissolved, and that the ZnO nanoparticles 22 are evenly dispersed without obvious agglomeration. After this step, the spinning solution (which is a suspension) is obtained. Next, in Step 58 the spinning solution is fed into a glass syringe 36. The glass syringe 36 is mounted on a syringe pump 32 with an 18-gauge metal needle 33. In Step 60 the fibres 24 are spun using an infrared heater 34 (at 120° C.) to obtain a stable jet solution during the whole fabrication. The heater 34 is employed on one lateral side of the syringe 36 and needle 33 as shown in FIG. 2. The syringe pump 32 is adjusted at a constant flow rate of 0.3 mL/hr. For the electrospinning, a spinning voltage of 25 KV is applied. A homogeneous layer of PE-ZnO nano-fabric 38 is deposited on a collector 42. The collector 42 is an aluminum foil fabric with a fixed area. The electrospinning deposition is carried out at a fixed distance of 15 cm between the tipping point of the spinneret and the collector 42. After eight hours of electrospinning, the nano-fabric 38 is removed from the collector and initially dried in Step 62 at 60° C. for 2 hours using a vacuum oven (not shown) to remove residual solvent. Finally, in Step 64 the nano-fabric 38 is completely covered by foils (not shown) and placed between flat metal plates 40 of a heat-press machine (not shown). The nano-fabric 38 is then treated with heat-pressing, with applied pressure, temperature and time were pre-set to be 0.14 MPa, 105° C. and 30 min, respectively. The heat-pressing of the nano-fabric 38 is conducted in both the face and back surface of the fabric to get maximum adhesion bonding within the structure. After the above process, the RCNF 20 is then obtained in Step 66.

With the above-described method, by using nanoparticle-doped polymer materials and electrospinning technology, the RCNF 20 which is an electrospun radiative cooling textile is developed with desired optical properties and good applicability. The textile made using the method according to Steps 50-66 above offers a cool fibrous structure with outstanding solar reflectivity (91%) and mid-infrared transmissivity (81%). In an outdoor field test under exposure of direct sunlight, the nano-fabric is demonstrated to reduce the simulated skin temperature by 9° C. when compared to skin covered by a cotton textile. A heat transfer model is also established to numerically assess the cooling performance of the nano-fabric as a function of various climate factors, including solar intensity, ambient air temperature, atmospheric emission, wind speed and parasitic heat loss rate. The results indicate that the nano-fabric can completely release the human body from unwanted heat stress in most conditions, providing an additional cooling effect as well as demonstrating world-wide feasibility. Even in some extreme conditions, the nano-fabric can also reduce the human body's cooling demand compared with traditional cotton textile, proving this material as a feasible solution for better thermoregulation of the human body. Besides, the nano-fabric possesses excellent strength that it can withstand with high mechanical force, making it suitable for application to textiles. The nano-fabric possesses also excellent breathability in that it has high air permeability, water evaporation rate, and water vapor transmission property, making it suitable for application to breathable textiles. Last but not the least, the nano-fabric has an excellent wearability performance in terms of mechanical, thermal and durability properties, further promoting its practical application.

The facile fabrication of such textiles paves the way for the mass adoption of energy-free personal cooling technology in daily life, which meets the growing demand for healthcare, climate change and sustainability. With minimal initial investment, training and supervision, electrospinning produces smart photon engineered textiles that make it faster and more economical to produce cooling textiles over melt-spinning process. Overall, embodiments of the invention provide insight to fabricate cooling textiles with a combination of highly spectrally selective polymers and inorganic nanomaterials using a facile electrospinning technology. Although at the beginning stage of this technology, electrospun fabric received only minimal attention due to challenges associated with low productivity and scalability, such issues have been addressed with the development of large-scale needleless electrospinning and near-field electrospinning.

The design process of the electrospun radiative cooling textile according to embodiments of the invention, its cooling performance as measured and simulated, and its optical performance, and wearability performance will be described hereinafter.

Design of the Electrospun Radiative Cooling Nano-Fabric

The electrospun radiative cooling nano-fabric for personal cooling is designed with the following specification: (i) the fabric thickness should be appropriate to get the maximum possible mid-infrared transmission and solar reflectivity; (ii) the collected fabric should fabricate with as much as high nanopores to achieve efficient breathability; and (iii) the accumulated fibrous structure must be mechanically strong to resist damage through normal wear. To satisfy the above requirements, a two-step manufacturing process like that described with reference to FIGS. 2-3, including electrospinning and heat-pressing treatment, is employed to fabricate the RCNF. Such methods could also be used to fabricate scalable nanofibrous textiles.

Figure 4A:
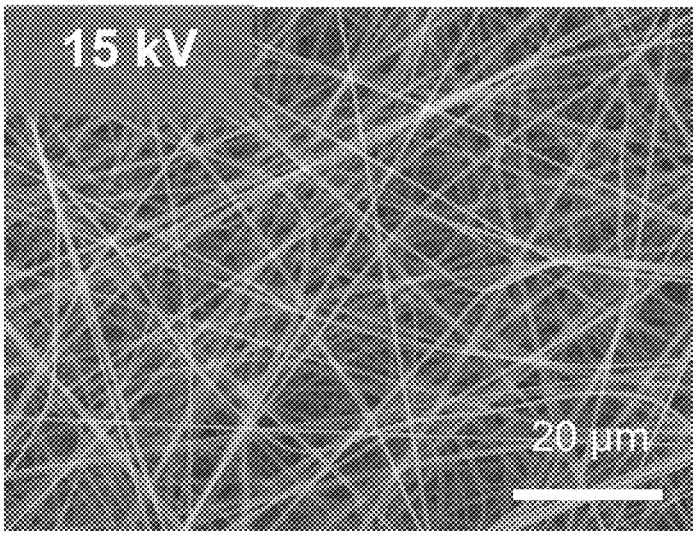
FIGS. 4*a*-4*c* show SEM (Scanning Electron Microscopy) images of constructed fibrous network with respectively voltage levels at 15 kV, 20 kV and 25 kV.
Figure 4B:
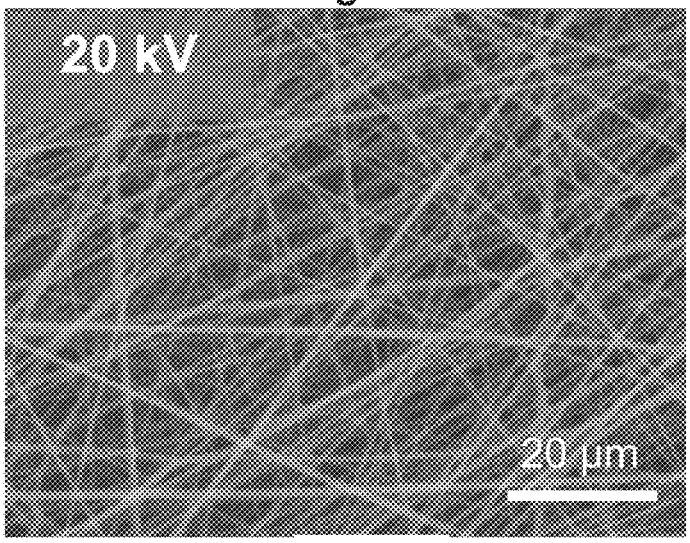
Figure 4C:
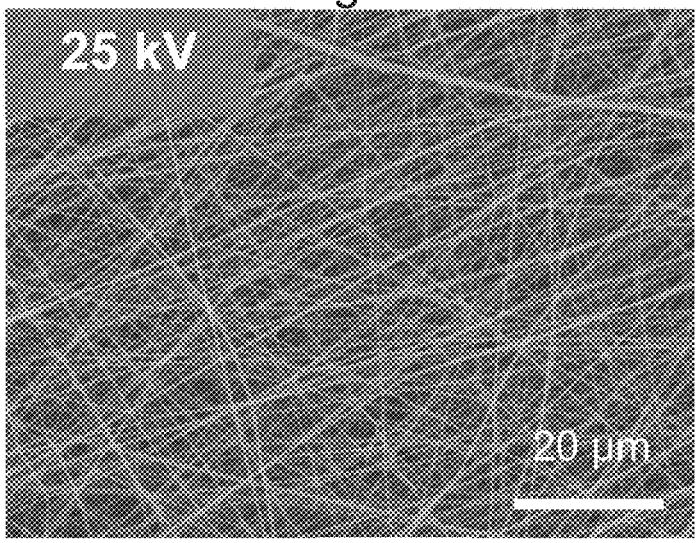
Figure 5A:
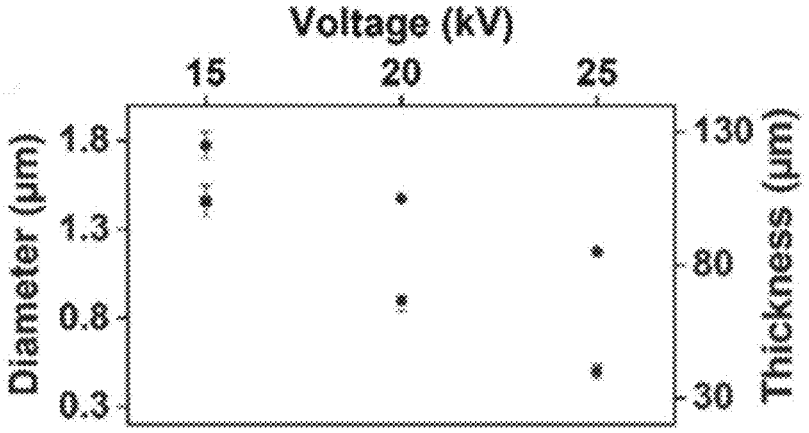
FIG. 5*a* illustrates quantitative relationship among the electrospinning voltages, diameters, and thicknesses of the RCNF.
Figure 5B:
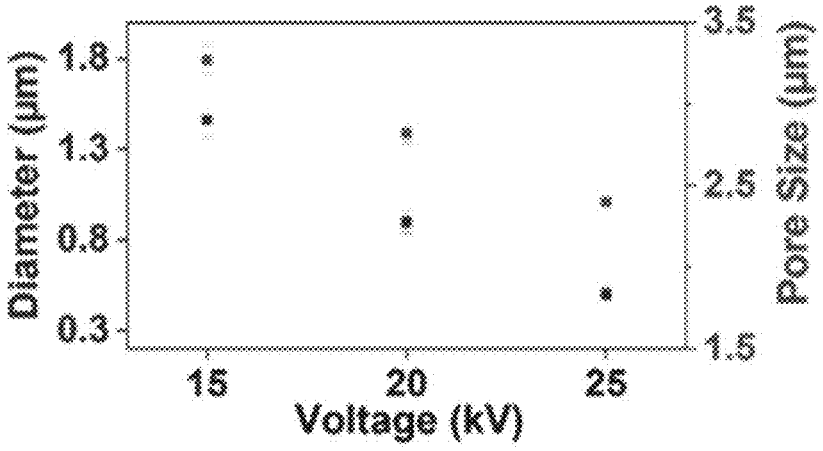
FIG. 5*b* illustrates quantitative relationship among the electrospinning voltages, diameters, and pore sizes of the RCNF.
Figure 6A:
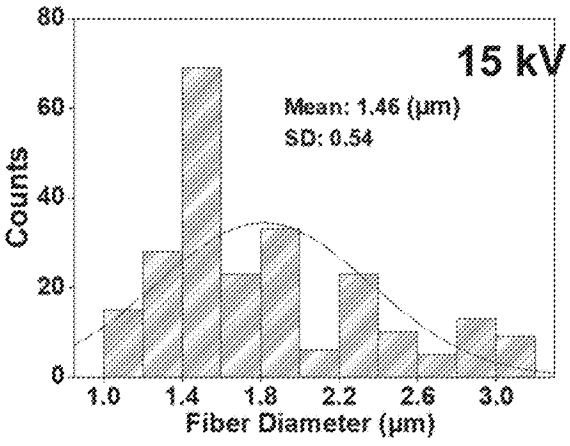
FIGS. 6*a*-6*c* illustrate the fibre diameter distributions of the RCNF with electrospinning voltages at respectively 15 kV, 20 kV and 25 kV.
Figure 6B:
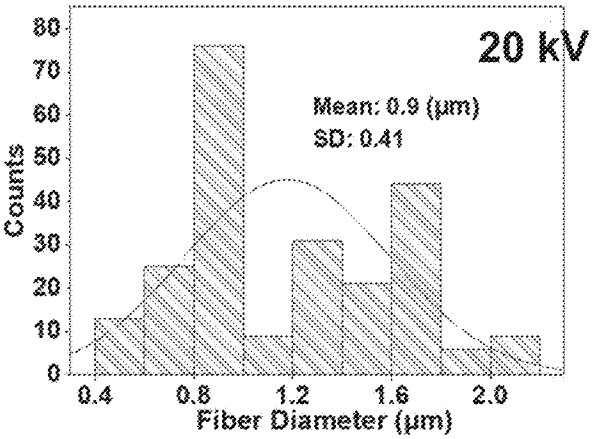
Figure 6C:
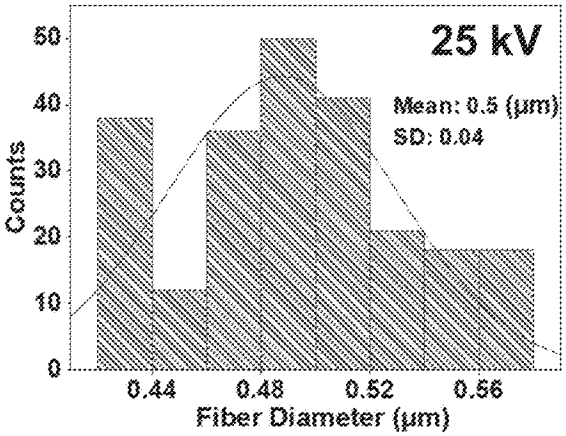
Figure 7:
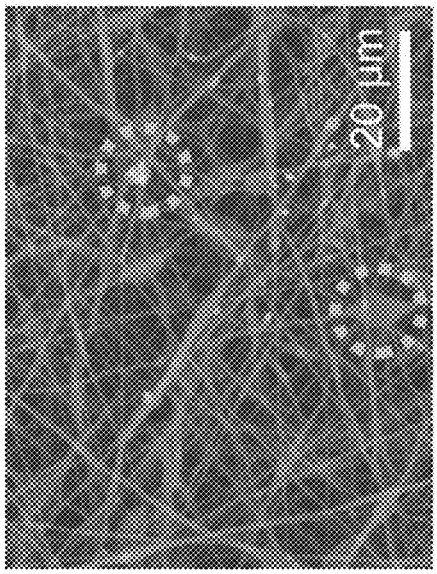
FIG. 7 shows a SEM image of the RCNF made with an electrospinning voltage of 30 kV.

The fibre diameter has a strong influence on the thickness and pore size of electrospun RCNF. Therefore, the first two requirements are addressed by successfully tailoring the fibre diameter throughout the fibrous structure by varying the voltage (kV). To satisfy the last criterion, heat-pressing is performed as a post-treatment to introduce inter-fibre bonding via heat treatment. Appropriate fabric thickness would play a very important role in solar reflectivity and mid-infrared transmissivity performance evaluation. Herein, the thickness of the RCNF was adjusted via tailoring the fibre diameter by maintaining suitable voltage. Aluminum foil fabric with a fixed area was used as the collecting substrate. Then, PE-ZnO fibres were electrospun on the substrate with various voltages in the range of 15 kV-30 kV (e.g. 15, 20, 25, 30 kV). Thus, the fabric thickness can be adjusted by fixing the substrate's area and controlling the fibre diameter via different voltage levels. FIGS. 4*a*-4*c* show SEM images of the constructed fibrous network in samples of RCNF made at different spinning voltages, which reveal that the diameter of the fibres changes with the increase of the voltage, indicating that the diameters could serve as an efficient factor for tailoring the thickness of the fabric. The quantitative relationship among the electrospinning voltages, diameter, and thickness of the RCNF are shown in FIGS. 5*a* and 5*b*. The RCNF manufactured under 15 kV had an average fibre diameter and thickness of 1.4 μm and 120 μm, respectively, which was attributed to the insufficient effective stretching of the liquid flow generated by the low electric field energy during the experiments. However, as the voltage was increased from 20 kV to 25 kV, the diameter and thickness of the RCNF were found to range from 0.85 μm to 0.45 μm and 105 μm to 85 μm, respectively, with more homogenous distribution in diameter being noticed as the voltage increased (See FIGS. 6*a*-6*c*). This remarkable phenomenon may be related to an enhanced balance between the electric field force and the dope solution's surface tension force, resulting in greater jet flow stability. However, as demonstrated in FIG. 7 (see the dotted circles), increasing the voltage to 30 kV causes protrusions on the surface of fibres due to the enhanced variability of the solution in the stretching stage of the solution flow. Therefore, RCNF with broken fibers and uneven diameters was obtained at 30 kV, creating a defective RCNF (see FIG. 7). To form a defect-free RCNF, spinning voltage up to 25 kV was considered for further fabrication discussion.

Figure 8C:
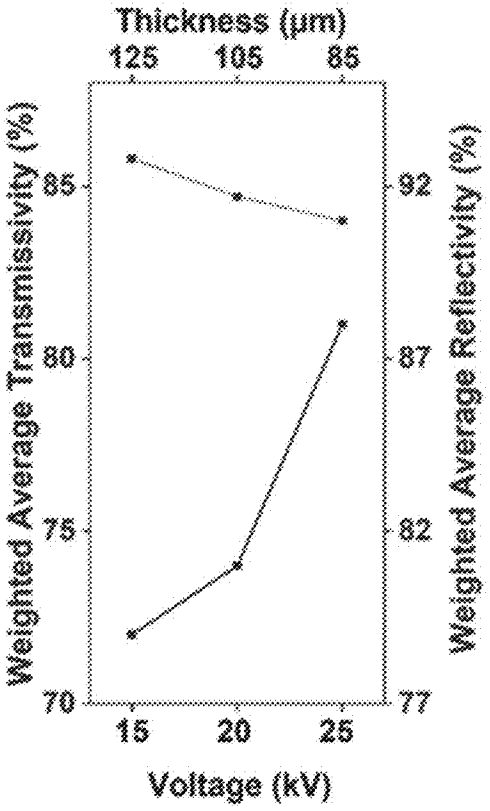
FIG. 8*c* is a diagram of Mid-infrared transmittance and UV-Vis-NIR reflectance of the RCNF as a function of voltage and thickness.
Figure 8B:
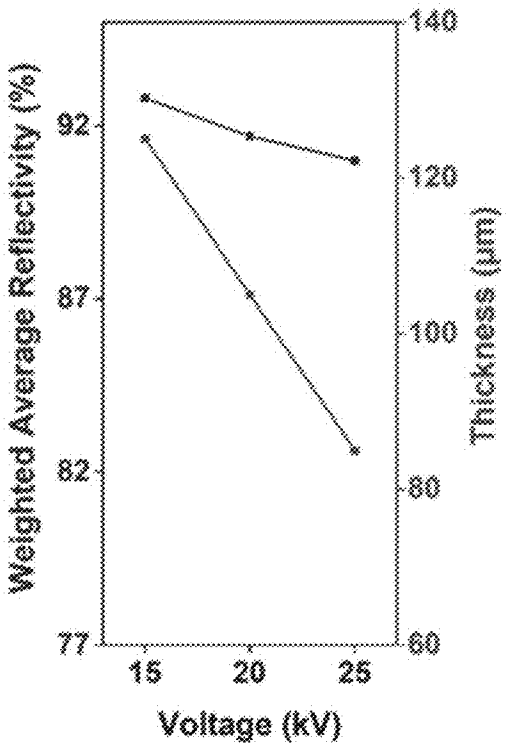
FIG. 8*b* is a diagram of UV-Vis-NIR reflectance of the RCNF as a function of voltage and thickness.
Figure 8A:
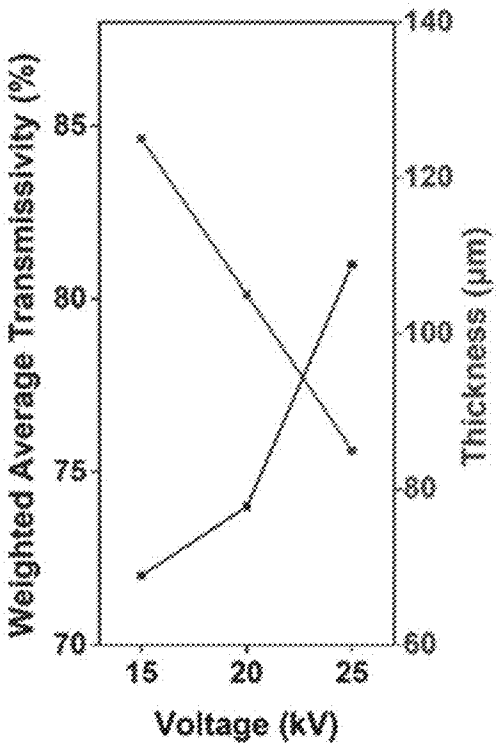
FIG. 8*a* is a diagram of mid-infrared transmittance of the RCNF as a function of voltage and thickness.
Figure 9:
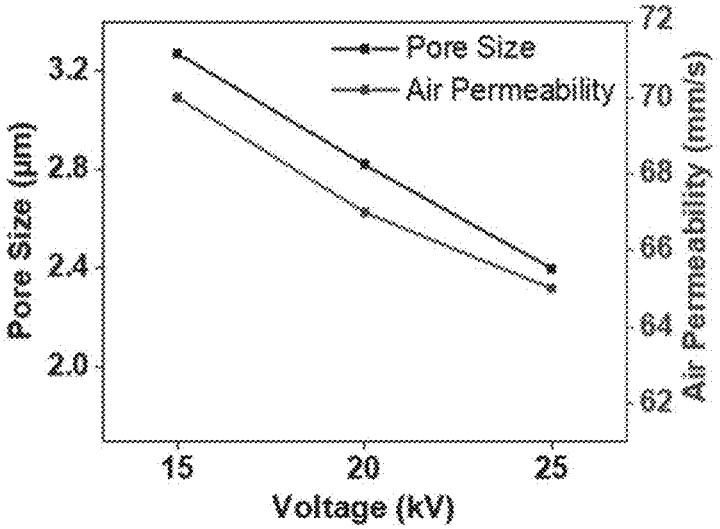
FIG. 9 shows the air permeability of the RCNF at a pressure drop of 100 Pa as a function of voltage and pore size.

High mid-infrared transmissivity can be seen with the increase of electric voltage (FIG. 8*a*). This may be due to the decrease in fabric thickness. However, it has been observed that a slight change in solar reflection as the voltage increases and the fabric thickness changes (FIG. 8*b*). This may be due to the presence of highly solar reflective ZnO nanoparticles and the existence of numerous nanopores in the RCNF that can efficiently reflect solar light. Overall, it can be observed from FIG. 8*c* that the RCNF with the thickness of around 85 μm is ideal for high solar reflection (91%) and mid-infrared transmission (81%). In addition, modifying the diameter of the fibres would greatly influence the average pore size of the fabric. FIGS. 5*a* and 5*b*, plotting the curves of average diameter and pore size of the RCNF under various voltages revealed a descending trend of pore size with an increase in voltage. This reduction was mainly due to the reduction in fibre diameter, making the gaps between two adjacent fibres narrower. The relevant air permeability was also investigated because the size of the pores influences the passage of air molecules and breathability (FIG. 9). The air permeability presented a decreasing tendency as the electrospinning voltage increased, which might explain the pore size reduction. Based on the discussion above, RCNF fabricated under a voltage of 25 kV would be a suitable candidate for efficient PE-ZnO radiative heat and thermal management. Therefore, this sample (S-25 kV) would be considered for further investigation and discussion.

Figure 10A:
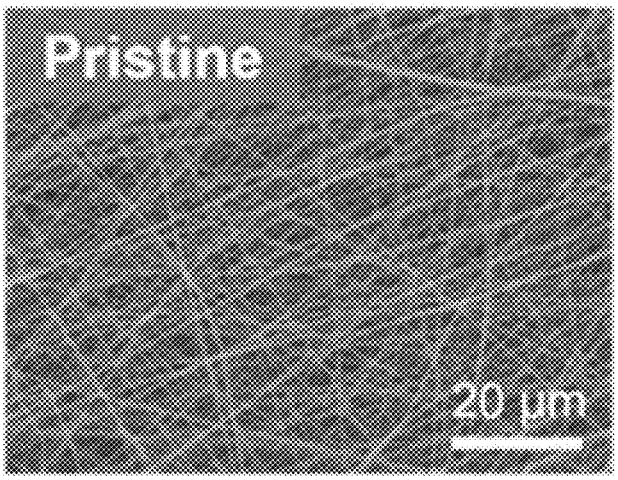
FIGS. 10*a* and 10*b* are SEM images of respectively the pristine and heat-pressed RCNFs.
Figure 10B:
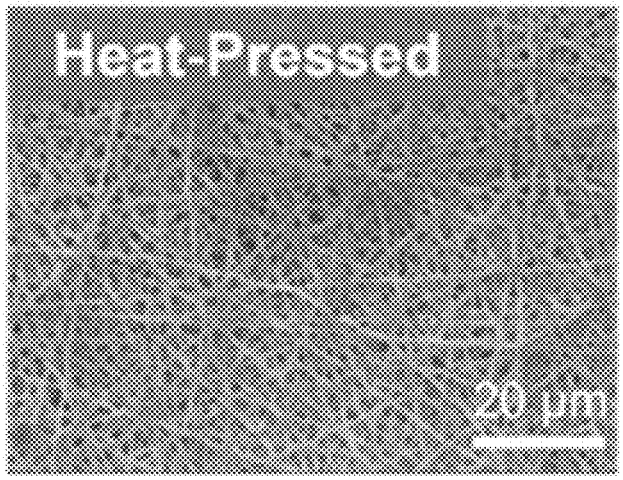
Figure 11:
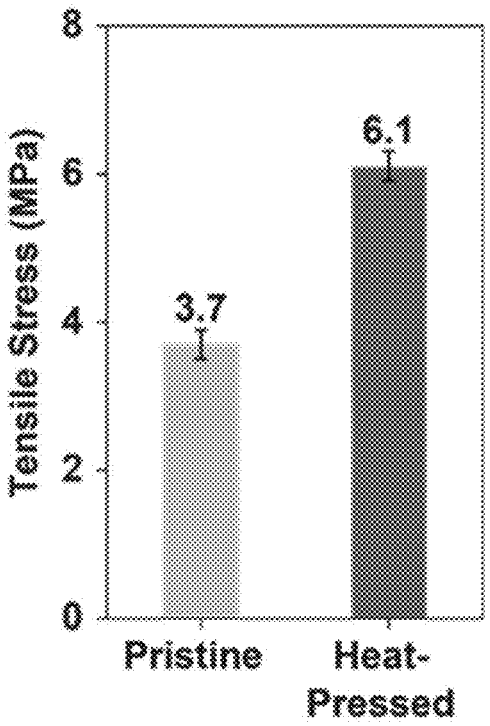
FIG. 11 illustrates the tensile stress property of the pristine and heat-pressed RCNFs.
Figure 12A:
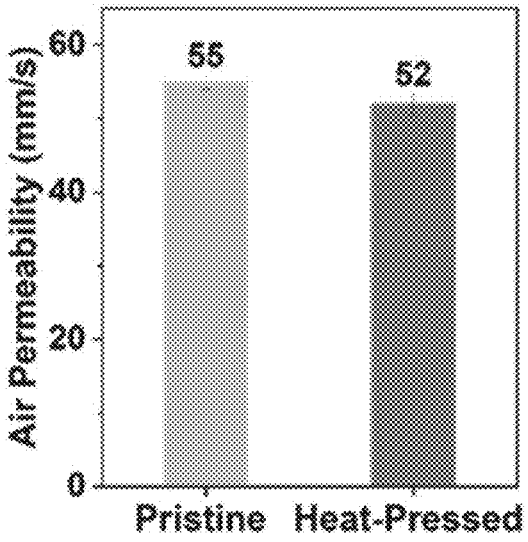
FIGS. 12*a*-12*c* illustrate respectively air permeability, bending stiffness and surface roughness of the pristine and heat-pressed RCNFs.
Figure 12B:
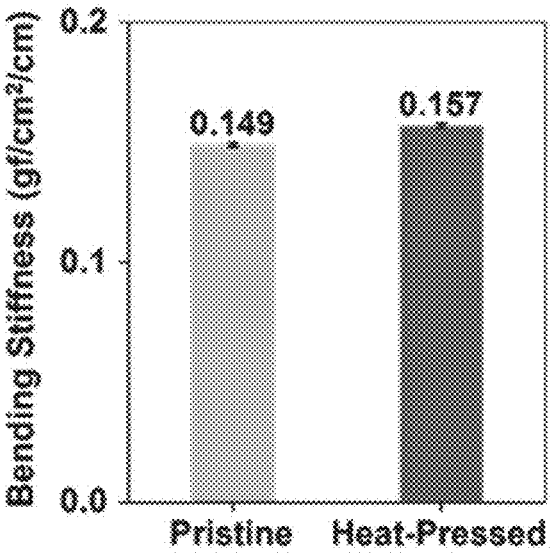
Figure 12C:
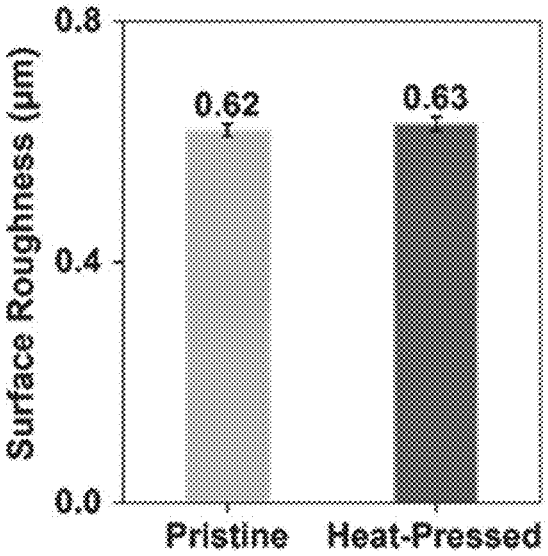

A lack of mechanical characteristics appears to be the fundamental flaw of electrospun nanofibrous fabric structures, as the fibres lose their orientation when relaxation processes start shortly after fibre synthesis. To alleviate this issue and meet the third criteria, heat-pressing as a post-treatment was performed. FIGS. 10*a* and 10*b* depict SEM images of the pristine and heat pressed RCNF, respectively. It is found that neighboring nanofibers joined and formed an adhesion structure in the nanofiber structure when subjected to heat pressing. This bonding and adhesion structure could have been induced by melting a small section of the PE between the nanofibers. Therefore, the heat-pressed RCNF tensile stress increased more than 60% (FIG. 11). The improved tensile performance was attributed to the inter-fibre fusion that occurred on the RCNF surfaces. In addition, due to the adhesion cross point, the RCNF has also shown alteration to air permeability (~5.5%), bending deformation (~5.4%) and surface roughness (~1.6%) than that of the pristine state as shown in FIGS. 12*a*-12*c*. However, it can be clearly seen that the effect is negligible.

Radiative Cooling Performance

The RCNF described above is composed of PE-ZnO matrix. PE, which is comprised of aliphatic C—H and C—C bonds, has previously been reported to be mid-infrared transparent, enabling it to fully transmit human body radiation for personal cooling. However, its solar reflectance is not satisfactory. Inorganic materials possess higher refractive index than polymers. Nevertheless, they absorb visible or mid-infrared radiation. ZnO is unique in that it has a high refractive index and low absorption from visible to mid-infrared radiation. The solar reflecting characteristics of the RCNF were significantly influenced by the particle size of ZnO nanostructures. According to classical Kubelkae Munk theory, the amount of light scattering increases with smaller particle size. Due to the use of smaller ZnO nanoparticles (~200 nm) in this study, the nanoparticles loaded PE exhibited higher solar reflectance. It is worth noting that although ZnO has high UV absorption, it has negligible impact on the overall cooling effect of RCNF since UV radiation only accounts for 5% in the whole range of the solar spectrum (i.e. 0.25 μm to 2.5 μm). Moreover, it has been confirmed that nanofiber diameters could serve as an efficient factor for tailoring the thickness of the fabric (FIG. 5*a*-5*b*) which can effectively tune the solar reflectivity of RCNF (FIG. 8*b*).

Figure 13A:
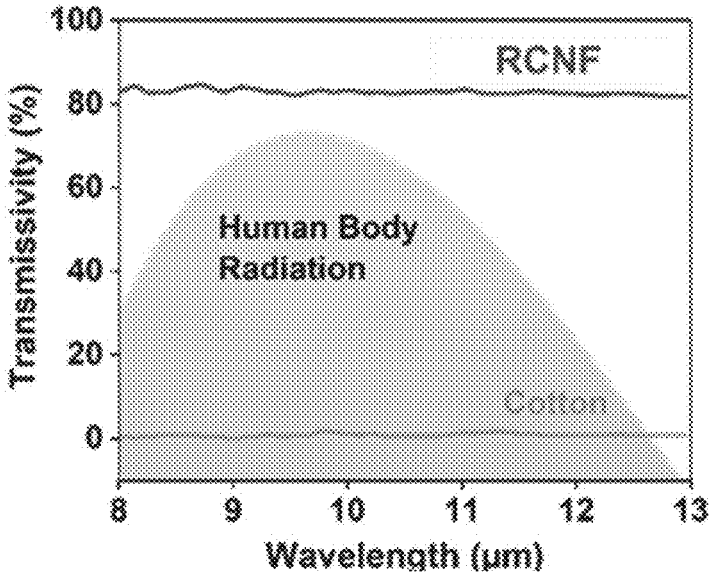
FIG. 13*a* shows the mid-infrared transmittance of RCNF and cotton.
Figure 13B:
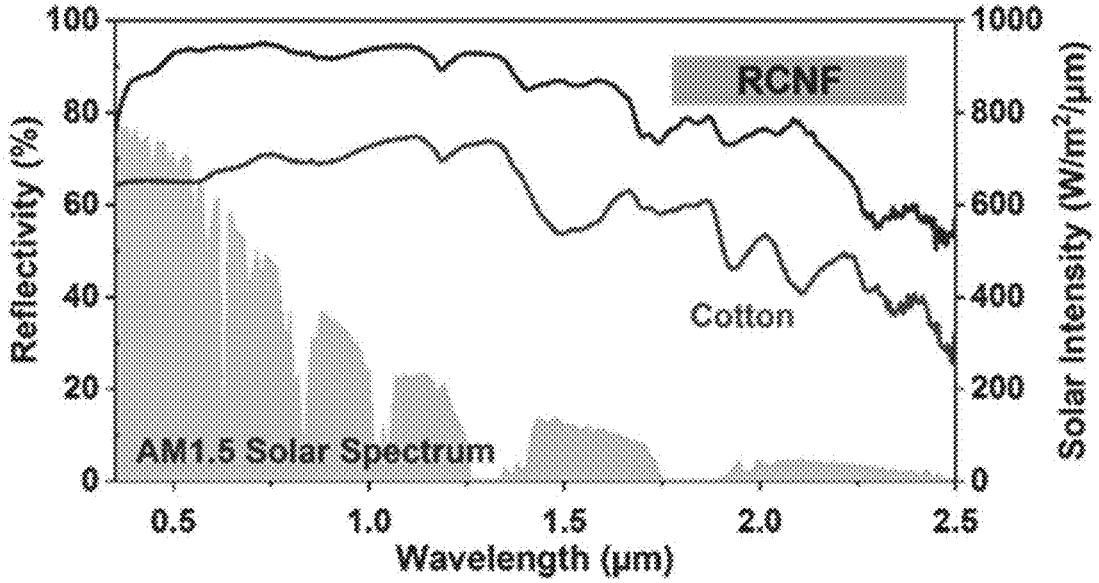
FIG. 13*b* shows the UV-vis-NIR reflectance spectra of RCNF and cotton.
Figure 14:
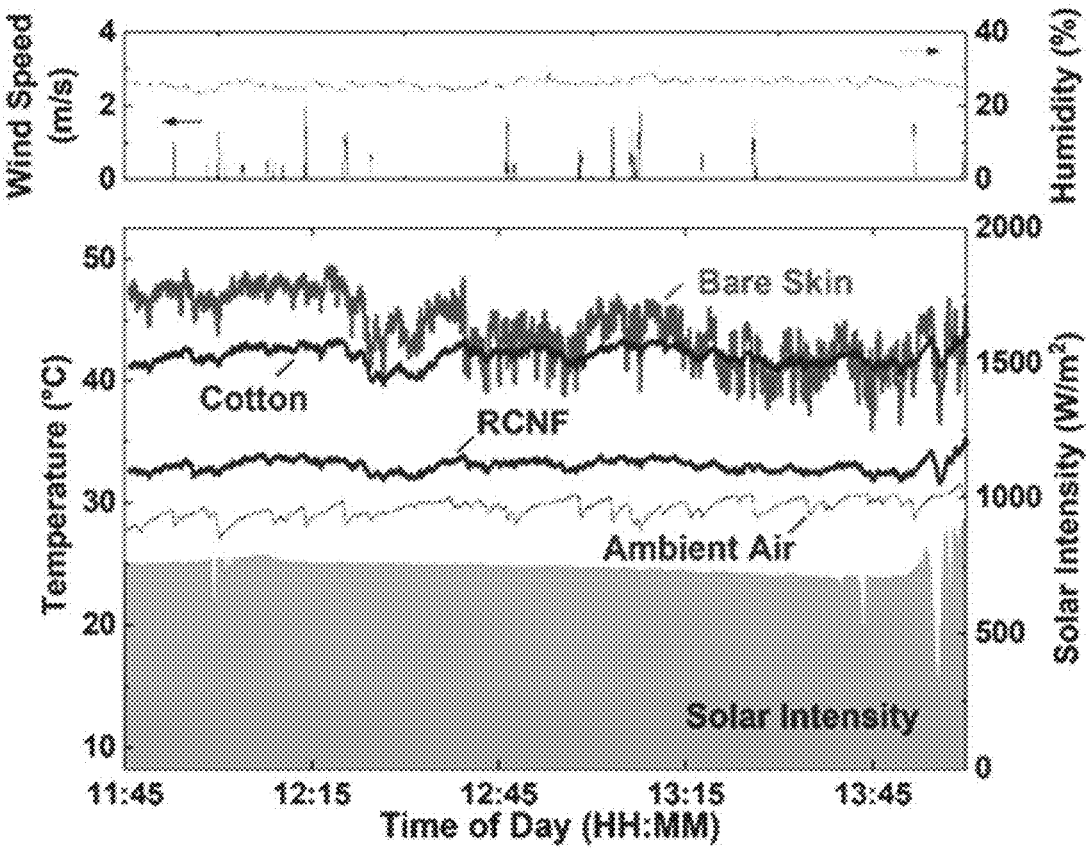
FIG. 14 shows the heater temperatures of the RCNF, cotton, and simulated bare skin measured using thermocouples in a field test.

The spectral optical property of the as-prepared RCNF 20 obtained from the method including Steps 50-66 is shown in FIGS. 13*a* and 13*b*. In the solar spectrum from 0.25 μm to 2.5 μm, the RCNF shows high reflectivity with a weighted average of 91%, attributed to efficient scattering by the ZnO and micro or nanofibers embedded in the fabric. As a result of low thermal absorption of both PE and ZnO, the nano-fabric possesses high transmissivity of 81% within 8 μm to 13 μm, where the human body thermal radiation centralizes. Given the advanced optical properties, in an outdoor space, the RCNF textile can reduce heat gain of the human body by reflecting most of the incoming sunlight. At the same time, the high mid-infrared transmission allows the human body to freely dissipate thermal heat to the surroundings. To investigate the effectiveness of RCNF to reduce heat stress in a real environment, a field test was conducted outdoors on a clear sunny day (late October 2021) in Hong Kong. The test was conducted under local weather conditions, including wind speed, humidity, ambient air temperature, solar intensity, measured using a weather station. Three dark-colored heaters were exploited to simulate the human skin. A thermocouple is placed on the heater to measure the temperature of the simulated skin, and there is a textile sample that covers the simulated skin. Each heater was continuously supplied with constant heating power of 104 $W/m^2$ to simulate the metabolic energy generation rate by a human body. One of the heaters was exposed to direct solar irradiation while the other two were covered with RCNF and cotton, respectively. The 2-hour continuous measurements of skin surface temperature and ambient climate during midday are presented in FIG. 14. The average temperature of the RCNF covered heater was 33° C., which was significantly lower than the temperatures of the white cotton-covered (42° C.) and bare (44° C.) skin-simulating heaters. Notably, the temperatures of these skin-simulating heaters were maintained the same under direct sunlight and shade conditions, indicating that the observed temperature changes were caused solely by the effects of the textile samples. Compared to the conventional skin-simulating heater, the RCNF covered skin-simulating heater achieved a significantly lower temperature due to the superior cooling power of PE-ZnO electrospun RCNF which can be attributed to its high solar reflection and nanopores created through electrospinning techniques, reducing the heat input from the sun, as well as its high mid-infrared transmission of human body thermal radiation, increasing radiative heat output to the cold universe (~3 K). Overall, RCNF can lower the human body's temperature during daylight hours, thereby lowering energy costs associated with human body cooling.

Numerical Assessment of Cooling Performance

To better understand the RCNF performance in regulating human thermal comfort, a numerical model is established to describe the thermal balance of human skin. Generally, for a skin surface that is exposed in an open outdoor space and subjected to direct sunlight, the cooling demand, $P_{cooling}$, for protecting the human body from heat stress and preventing excessive sweating can be described as:

$$P_{cooling}=P_{heat\ stress}+P_{evap}=P_{gen}+P_{solar}+P_{ir_gain}-P_{ir_loss}-P_{non\text{-}rad} \quad (1)$$

where $P_{gen}$ is the heat generation rate by human body, and $P_{solar}$ is the absorbed solar irradiation. For a textile covered skin, $P_{ir_gain}$ is the infrared radiative heat gain on the object's surface, which includes radiation from the atmosphere and textile. $P_{ir_loss}$ is the infrared radiative heat loss rate by the skin. $P_{non\text{-}rad}$ is the heat dissipation rate through non-radiative method which includes conduction and convection. In a typical summer day, the conditioned indoor space provides occupants with thermal comfort by passive shading and active cooling. When people go outdoors, where the heat gain becomes intensive, sweating takes place to provide cooling, which is donated by $P_{evap}$. In an extreme situation where sweat evaporation fails to compensate extra heat gain, the human body suffers heat stress, which is donated by $P_{heat\ stress}$.

In the cooling performance field test, the thermal balance of the simulated skin was achieved by its surface temperature response because the simulated skin was not supplied with cooling and did not have an adaptive mechanism like the human body, i.e., $P_{cooling}=0$. The measured temperature of bare skin-simulating heaters, solar intensity and ambient air temperature were first used to obtain the non-radiative heat transfer coefficient throughout the field test period by using the thermal balance model, i.e., Equation (1). The details of the thermal balance model for heat regulation performance of RCNF and cotton are described below.

To solve the cooling demand that is needed to maintain the skin surface temperature at 34° C. under a stable body heat generation (i.e. $P_{gen}$=104 W/m$^2$), three steady state thermal equilibriums, i.e., Equation S1a-e, Equation S2a-e and Equation S3a-e, are established based on the governing Equation (S0). The details are list as below.

$$P_{cooling}=P_{heat\ stress}+P_{evap}=P_{gen}+P_{solar}+P_{ir_gain}+P_{ir_loss}-P_{non\text{-}rad} \quad (S0)$$

At the skin surface:

$$P_{gen} = 104\ \mathrm{W/m^2} \quad (S1a)$$

$$P_{solar} = q_{sun}\tau_{solar,textile}(1-\rho_{solar,skin})\sum_{n=0}^{\infty}(\rho_{solar,skin}\rho_{solar,textile})^n \quad (S1b)$$

$$P_{ir_gain} = \sigma\varepsilon_{bb,textile}\varepsilon_{bb,skin}T_{textile_in}^4 + \tau_{bb,textile}\sigma\varepsilon_{bb,skin}(1-\tau_{bb,atm})T_{amb}^4 \quad (S1c)$$

$$P_{ir_loss} = (1-\rho_{textile,bb})\sigma\varepsilon_{bb,skin}T_{skin}^4 \quad (S1d)$$

$$P_{non-rad} = \frac{k_{air}}{t_{air}}(T_{skin}-T_{textile_in}) \quad (S1e)$$

At the outer surface of the textile:

$$P_{gen}=104\ \mathrm{W/m^2} \quad (S2a)$$

$$P_{solar}=q_{sun}(1-P_{solar,textile}-\tau_{solar,textile}^2\rho_{solar,skin}\Sigma_{n=0}^{\infty}(\rho_{solar,skin}\rho_{solar,textile})^n) \quad (S2b)$$

$$P_{ir_gain}=(1-\rho_{bb,textile})\sigma(1-\tau_{bb,atm})T_{amb}^4 \quad (S2c)$$

$$P_{ir_loss}=\sigma\varepsilon_{bb,skin}T_{skin}^4+\sigma\varepsilon_{bb,textile}T_{textile_out}^4 \quad (S2d)$$

$$P_{non\text{-}rad}=h(T_{textile_out}-T_{amb}) \quad (S2e)$$

For the temperature profile between the outer surface and the inner surface of the textile:

$$P_{gen} = 0\ \mathrm{W/m^2} \quad (S3a)$$

$$P_{solar} = q_{sun}\left[(1-\rho_{solar,textile}) - \frac{\tau_{solar,textile}^2\cdot\rho_{solar,skin}+\tau_{solar,textile}\cdot(1-\rho_{solar,skin})}{1-\rho_{solar,textile}\cdot\rho_{solar,skin}}\right] \quad (S3b)$$

$$P_{ir_gain} = \varepsilon_{bb,textile}\sigma T_{skin}^4 + \varepsilon_{bb,textile}\sigma T_{amb}^4 \quad (S3c)$$

$$P_{ir_loss} = \varepsilon_{bb,textile}\sigma T_{textile_in}^4 + \varepsilon_{bb,textile}\sigma T_{textile_out}^4 \quad (S3d)$$

$$P_{non-rad} = \frac{k_{textile}}{t_{textile}/2}(T_{textile_in}-T_{textile_out}) - \frac{k_{air}}{\frac{t_{air}}{2}}(T_{skin}-T_{textile_{in}}) \quad (S3e)$$

where $q_{sun}$ is the AM 1.5 standard solar radiation, $\tau_{solar}$ and $\rho_{solar}$ are the average solar transmission and reflection which are calculated by weighting the measured spectral transmissivity and reflectivity by AM 1.5 standard solar radiation, respectively. The solar reflection of simulated skin, $\rho_{solar,skin}$, is measured to be 0.33. As the transmission of the skin's surface is 0, the $\varepsilon_{skin,solar}$ is obtained by $1-\rho_{skin,solar}$. $\sigma$ is the Stefan-Boltzmann Constant, i.e., $5.670367\times10^{-8}$ kgs$^{-3}$K$^{-4}$. $\tau_{bb}$, $\varepsilon_{bb}$, $\rho_{bb}$ are the average infrared transmission, emission and reflection calculated by weighting the measured spectral transmissivity, emissivity and reflectivity weighted by black body radiation at room temperature, respectively. $\tau_{bb,atm}$ is the atmospheric infrared transmission. $T_{amb}$, $T_{skin}$, $T_{textile_in}$, $T_{textile_out}$ are the temperatures of ambient air, simulated skin, and outer and inner surfaces of the textile, respectively. h is the heat transfer coefficient considering convection and conduction. $k_{textile}$ and $k_{air}$ are the thermal conductivities and thicknesses of the textile and air gap between textile and skin, while $t_{textile}$ and $t_{air}$ are the thicknesses of the textile and air gap between textile and skin, respectively.

Figure 15A:
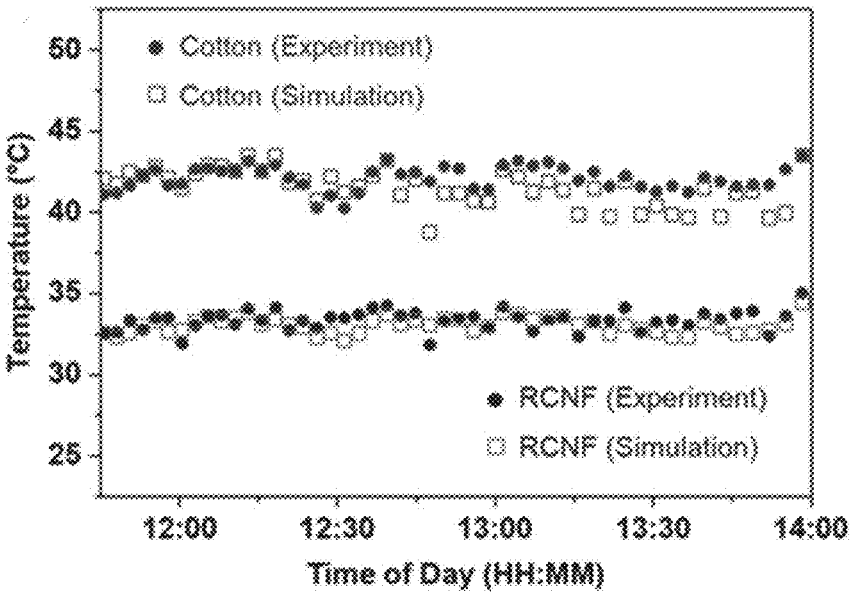
FIG. 15*a* shows a comparison of skin-simulating heater temperatures obtained from the outdoor field test (solid circular) and the numerical thermal balance model (hollow square).
Figure 15B:
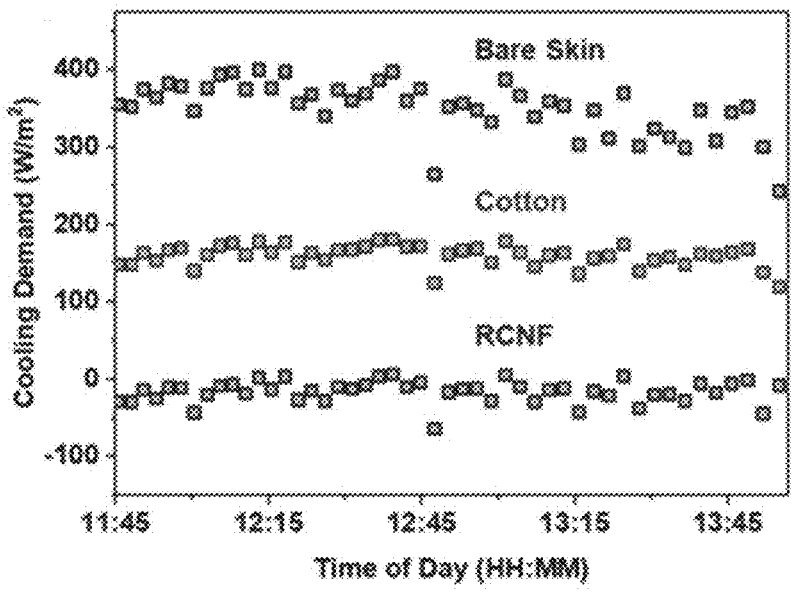
FIG. 15*b* shows a calculated cooling demand for the skin to maintain 34° C. throughout the field test.

When calculating the temperature of heaters in the field test, the $P_{cooling}$ is equal to 0. The measured temperature of bare skin-simulating heaters, solar intensity and ambient air temperature are firstly used to calculate the non-radiative heat transfer coefficient, i.e., h, by solving the Equation (S0) and Equation (S1a-e). Due to the fact that the bare skin does not cover any textiles, when doing the calculation, $\tau_{solar,textile}$ and $\tau_{bb,textile}$ are both equal to 100%, $\rho_{solar,textile}$ and $\varepsilon_{bb,textile}$ are equal to 0, $P_{non-rad}$ is equal to $h(T_{skin}-T_{amb})$. Using the fitted non-radiative heat transfer coefficient, the temperature of skin-simulating heaters covered by cotton and RCNF is calculated by using the Equation (S0), Equations (S1a-e), Equations (S2a-e) and Equations (S3a-e). The calculation result is shown in FIG. 15*a* in the main context. To calculate the cooling power ($P_{cooling}$) that is demanded to maintain the human body at a stable state, the human body temperature is set as 34° C. Then, the results are obtained by solving the Equation (S0) and Equations (S1a-e), as shown in FIG. 15*b*.

Figure 15C:
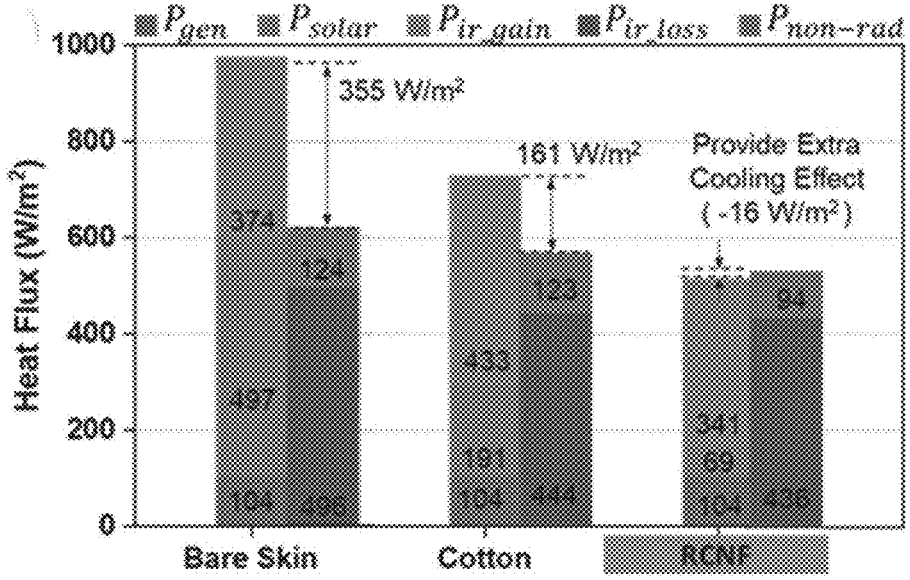
FIG. 15*c* shows cooling demand of bare skin, cotton-covered skin and RCNF covered skin, calculated based on the empirical results.

Using the fitted non-radiative heat transfer coefficient, the temperatures of skin-simulating heaters covered by RCNF and cotton were calculated. As shown in FIG. 15*a*, calculated temperatures are consistent with the measured result from the field test with an average error of 1.7% and 2.1% for RCNF and cotton, respectively, validating the proposed thermal balance model. Considering thermal balance at the skin surface and textile, the cooling power, $P_{cooling}$, required to maintain the skin temperature at 34° C. (FIGS. 15*b* and 15*c*) is calculated. Due to intensive solar absorption, bare skin suffers the most intensive heat stress and thus requires an average cooling power over 300 W/m$^2$. Even with the skin covered by cotton, a cooling demand of 161 W/m$^2$ is still needed. The RCNF however, is capable to maintain the skin at a normal temperature without any cooling power throughout the field test period. Notably, RCNF can prevent the skin from most of the incoming solar irradiation due to its high solar reflection. As a result, the heat gain caused by sunlight is reduced by 86% and 63% when comparing RCNF with bare skin and cotton, respectively. Moreover, RCNF covered skin performs much lower external radiative heat gain ($P_{ir_gain}$) than that of the cotton covered skin. Compared with RCNF, cotton has higher mid-infrared reflectivity, which impedes the radiative heat dissipation from the skin, while worsening radiative heat gain at the same time. Consequently, $P_{rad}$ of the cotton covered skin is even higher than that of bare skin, which leads to unwanted heat stress. In contrast, the RCNF has high transmittance and low absorption in the mid-infrared range, which maximizes the heat output and achieves a 21% lower thermal radiative heat gain over cotton, which confirms the successful release of human body heat to the surroundings by radiation.

Figure 15D:
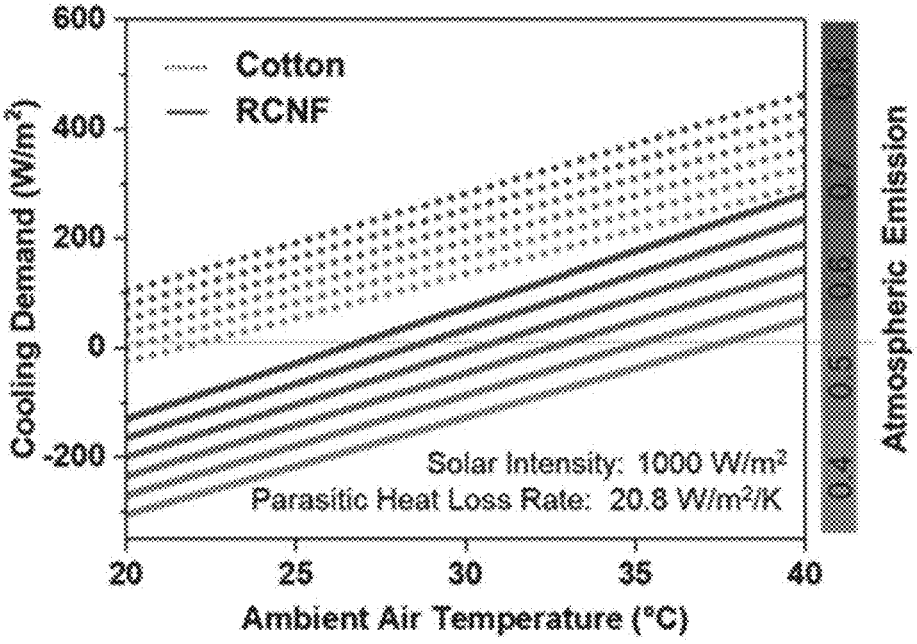
FIG. 15*d* shows cooling demand for cotton (dotted line) and RCNF (solid line) under different atmospheric emissions as a function of ambient air temperature.
Figure 15E:
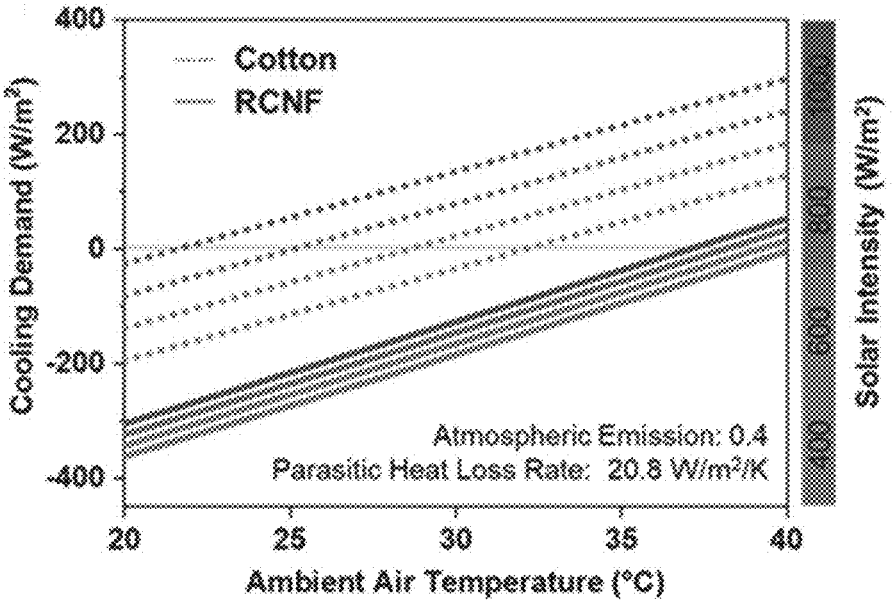
FIG. 15*e* shows cooling demand for cotton (dotted line) and RCNF (solid line) under different solar intensity levels as a function of ambient air temperature.
Figure 15F:
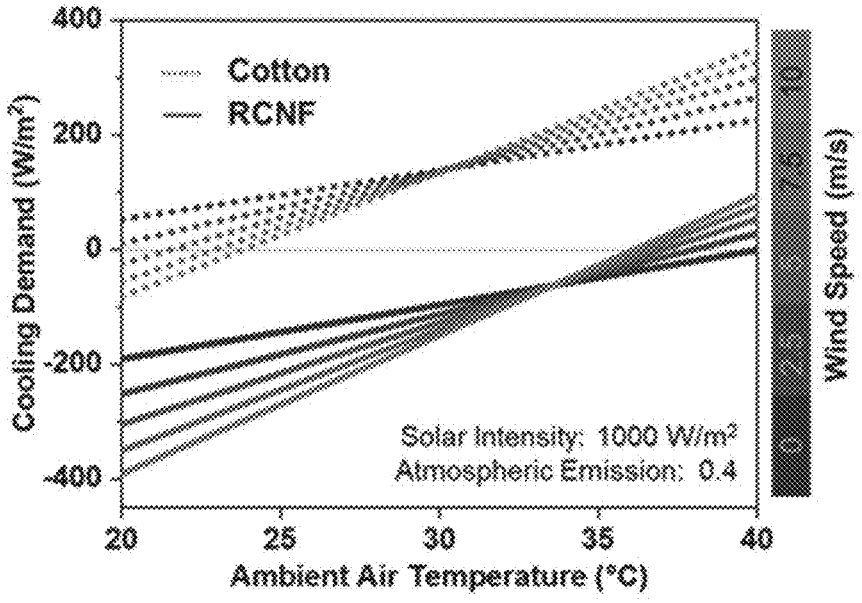
FIG. 15*f* shows cooling demand for cotton (dotted line) and RCNF (solid line) under different wind speeds as a function of ambient air temperature.

Apart from the textile's optical properties, external factors also influence the thermal performance. FIGS. 15*d* and 15*e* indicate that the atmospheric emission, solar intensity, and ambient temperature were all significant factors that influence the textile's performance on thermal regulation. The ambient air emission is related to local humidity and cloud coverage. The increased water content in the atmosphere absorbs the mid-infrared radiation in the range of 8-13 μm, and thus attenuated atmospheric transmission. It can be seen clearly that more cooling demand is required with a higher atmospheric emission, where the mid-infrared radiation emitted by the human body cannot efficiently dissipate to outer space. At ambient temperature of 30° C., RCNF provides additional cooling of 127 $W/m^2$ for the human body in conditions of 0.4 atmospheric emission but fails to do so when the atmospheric emission is over 0.7. In FIG. 15*e*, different solar intensity levels are also investigated under an atmospheric emission of 0.4. The increased solar intensity level leads to an increase in cooling demand. As the RCNF has a high solar reflection, the change in solar intensity poses less impact on the cooling demand compared to cotton, which is desirable to achieve a stable thermal feeling for the human body when being active under the sun. The parasitic heat loss caused by local wind speed fluctuation also affects the overall cooling demand. As shown in FIG. 15*f*, the wind speed ranging from 0 m/s to 10 m/s is considered, which corresponds to the parasitic heat loss rate from 0 $W/m^2/K$ to 33.3 $W/m^2/K$, and it is found that by wearing the RCNF, the human body requires less cooling than cotton. Under the five wind speed conditions, the advanced optical properties of RCNF promise around 125 $W/m^2$-150 $W/m^2$ less cooling demand compared with cotton under different wind speed conditions. It is also noticed that the cooling demand increases for both cotton and RCNF as the wind speed increases, indicating that the parasitic heat exchange is unwanted since it will accelerate the heat gain of the body from the hot air. While, under a low air temperature condition, enhanced parasitic heat loss caused by higher wind speed is desired because wind with lower temperature than the textile helps to bring the heat away, and thus reducing the cooling demand. To conclude, the numerical investigation further confirms that RCNF has great potential to replace traditional textiles with its advanced optical properties and thermal regulation capability.

Wearability Performance

Figure 16A:
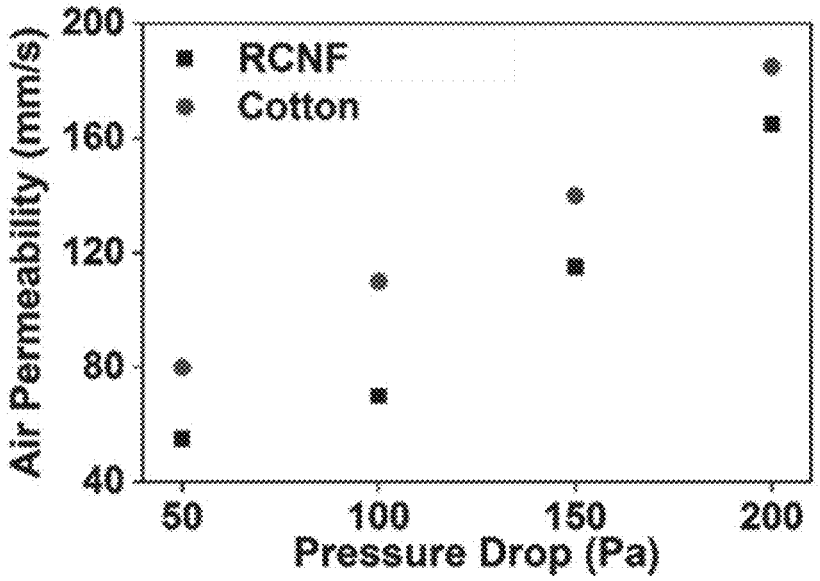
FIG. 16*a* shows the air permeability of the RCNF and cotton.
Figure 16B:
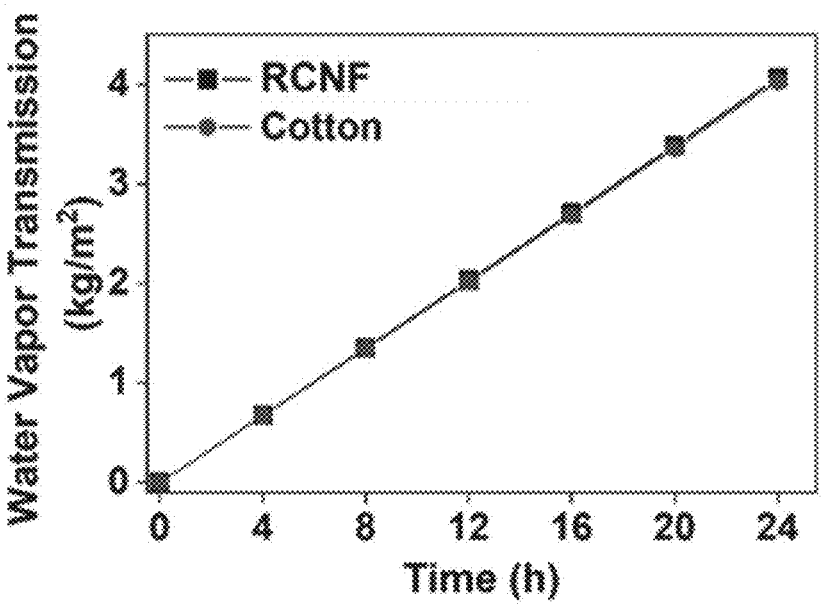
FIG. 16*b* shows water vapour transmission of the RCNF and cotton.
Figure 16C:
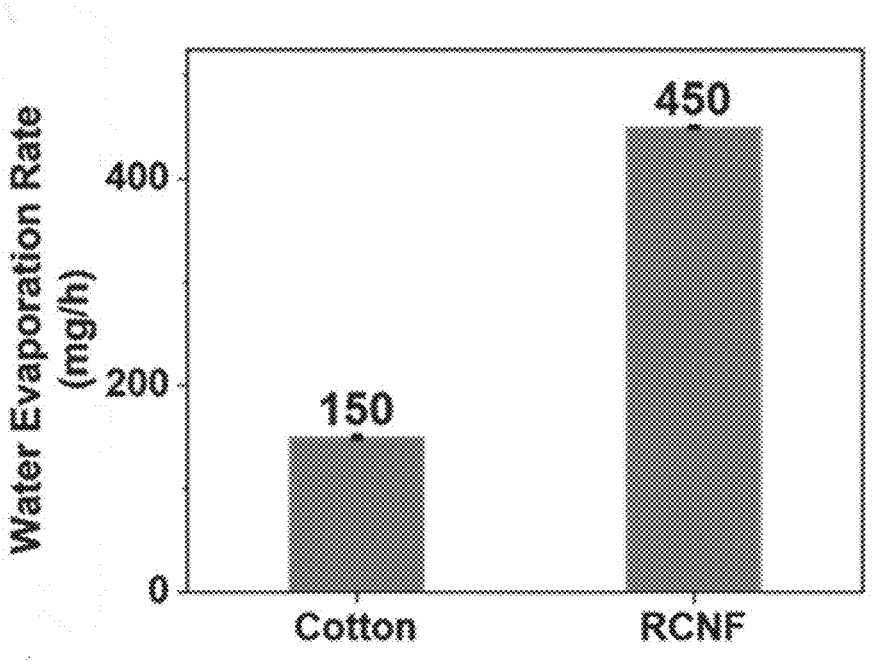
FIG. 16*c* shows water evaporation rate of the RCNF and cotton.

In addition to excellent radiative cooling performance, clothing should also possess appropriate wearability properties, such as air permeability, thermal conductivity, warm/cool sensation, vapor transmission, fast drying and durability. FIGS. 16*a*-16*f* illustrates wearability performance of RCNF 20 obtained from the method including Steps 50-66. The breathability performance is essential to ensure body comfort and healthcare by transferring away body heat, which is highly desirable for cooling textiles. The breathable performance was assessed by examining the air and water vapor permeability of RCNF, as illustrated in FIGS. 16*a* and 16*b*, respectively. The cotton textile containing 100% cotton had a porous structure with a pore size of 25 μm, a weight of 180 $g/m^2$, and a tensile stress of 16 MPa. The RCNF is composed of micro/nanopores with a pore size of 1.1 μm (FIGS. 5*a*-5*b*). Therefore, RCNF had lower air permeability (~55 mm/s) than that of the commercial cotton fabric (80 mm/s) under a pressure difference of 50 Pa as shown in FIG. 16*a*. The similar trend was also observed under various pressure levels (100, 150 and 200 Pa). The poor air permeability of RCNF was attributed to the smaller pore size. However, they were both significantly superior to commercial jeans (approximately 10 mm/s) in terms of air permeability. Besides, the rate at which water vapor is transferred from wet skin to the environment via a textile is essential data for the transfer of heat and moisture. The electrospun nanofibers were orientated randomly to generate an interconnected pore structure, with most pores larger than 0.1 μm (FIGS. 5*a*-5*b*), which are larger than sweat vapor and could act as channels to transport moisture vapor for passive cooling of the human body. As shown in FIG. 16*b*, the water vapor transmission rate of RCNF (4.06 $kg/m^2/24$ h) is slightly higher than that of cotton (4.03 $kg/m^2/24$ h), indicating that electrospun cloth nanopores can easily transport water vapor from perspiration through natural diffusion and evaporation, similar to cotton. The ingenious structure and nanoscale cavities within the RCNF fabric are responsible for this advantage. The interstitial space between the fibres, as well as the ideal channel network of nanopores, considerably enhance the passage of water vapor in the RCNF. From the results of water vapor transmission, the RCNF is qualified to be comparable with the widely accepted breathable traditional cotton fabric. Apart from the water vapor transmission, the fast-drying ability of liquid water by the fabric is also an essential issue for textiles because they significantly affect the human physiological comfort. In general, fast-drying properties are often characterized by the water evaporation rate (WER). FIG. 16*c* compares the WER of RCNF and cotton fabrics. It can be seen that RCNF shows the WER at 450 mg/h which is three times higher than that of cotton fabric (i.e. 150 mg/h). Note that the WER through porous fibrous materials is a complex process, which is determined by hydrophilicity/hydrophobicity and area density of the materials. In this study, the hydrophilicity/hydrophobicity of the RCNF and cotton is measured by the water contact angle (WCA). The WCA of RCNF is about 144.6° (FIG. 17*a*), which is greater than 90° to meet the requirement of hydrophobicity. On the contrary, cotton instantly absorbed water with WCA of 0°. Besides, from FIG. 17*b*, RCNF has a much lower area density (i.e. 0.025 $g/m^2$) than that of cotton (i.e. 180 $g/m^2$), implying that cotton readily absorbed more water per unit area which requires more time to dry out. As a result, RCNF shows faster drying performance than cotton.

Figure 16D:
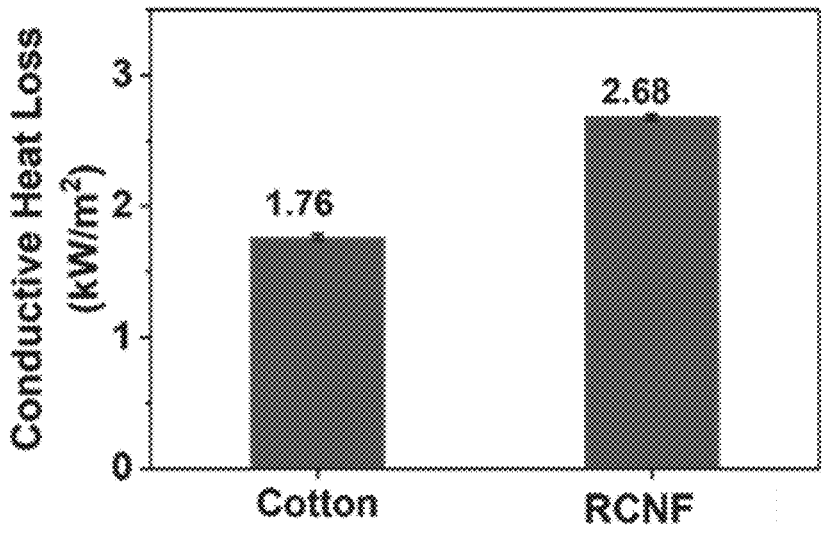
FIG. 16*d* shows conductive heat loss of the RCNF and cotton.
Figure 16E:
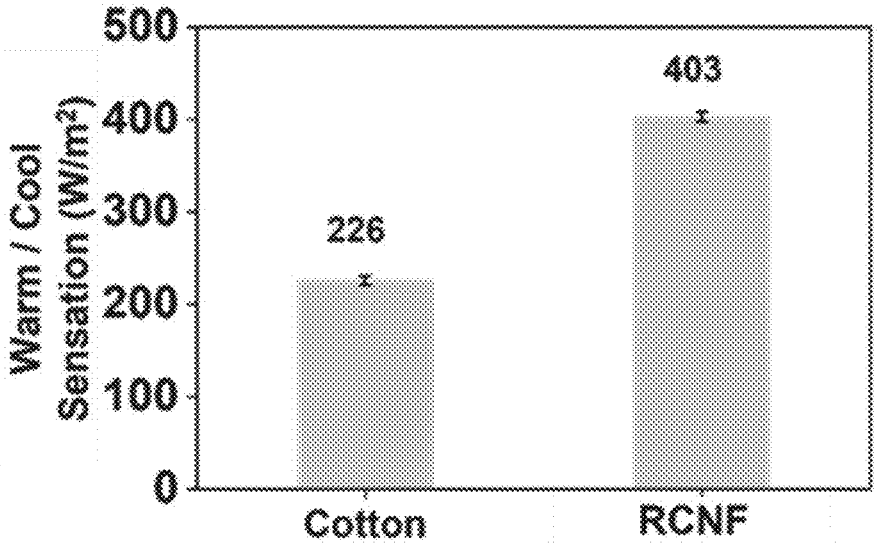
FIG. 16*e* shows warm/cool touch ($Q_{max}$) of the RCNF and cotton.
Figure 17A:
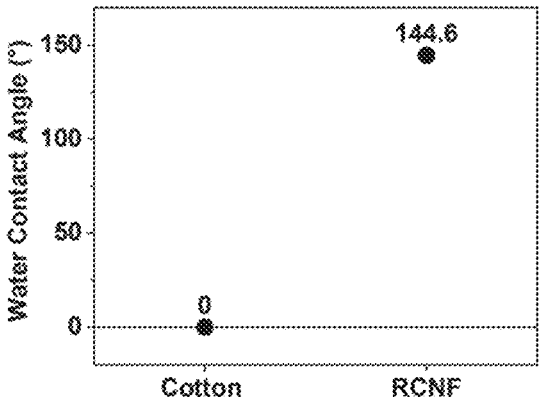
FIG. 17*a* shows water contact angles of cotton and RCNF.
Figure 17B:
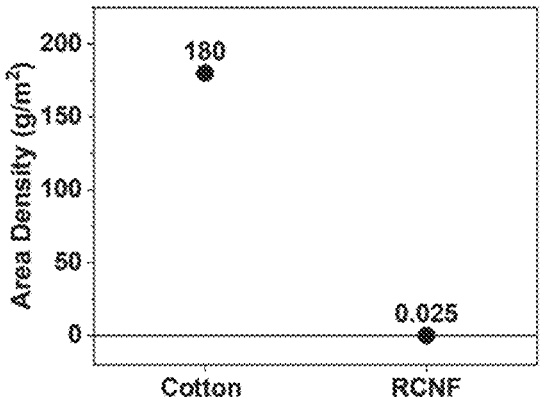
FIG. 17*b* shows area densities of cotton and RCNF.
Figure 18A:
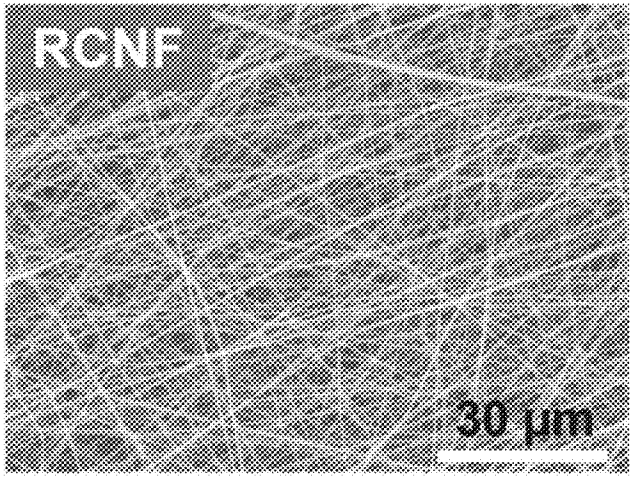
FIG. 18*a* illustrates a SEM image of as-prepared RCNF.
Figure 18B:
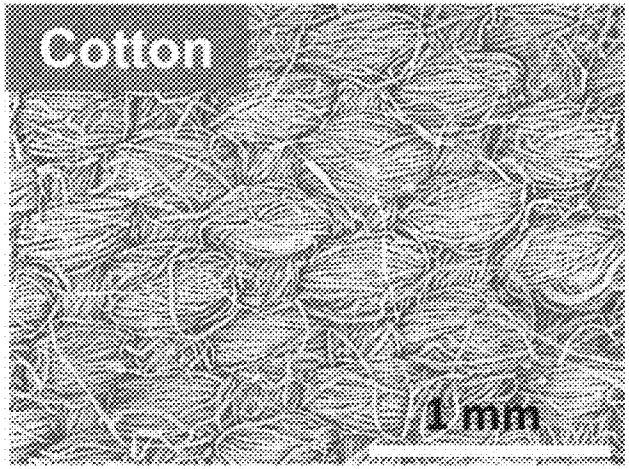
FIG. 18*b* illustrates a SEM image of cotton.

As for active heat dissipation, thermal conductive heat loss and an immediate surface warm/cool sensation ($Q_{max}$) caused by skin contact with the fabric sample is tested. FIGS. 16*d* and 16*e* showed the measured conductive heat loss and $Q_{max}$ of RCNF and cotton, respectively. Typically, a higher thermal conductive heat flux indicates that more heat is transported from skin to fabric, which results in a cooler feeling on the body. This facilitates the transfer of heat in hot climates, particularly in the summer where thermal conductive heat loss makes the process of body heat transfer easy. According to FIG. 16*d*, electrospun RCNF (2.68 $kW/m^2$) exhibits a much greater conductive heat loss than that of the cotton (1.76 $kW/m^2$). These findings are most likely related to the internal structure of the fabric. The electrospun structure significantly lowers the void spaces on the RCNF compared to woven cotton structure surfaces, resulting in the reduction of air trapped, and hence an increase in the thermal conductive heat loss. Additionally, the warm or cool touch feeling test to measure the maximum heat loss ($Q_{max}$) has also been performed, in which the $Q_{max}$ was defined as the maximum value of instantaneous heat flow passing through the fabrics at the time of skin contact with the fabric. As shown in FIG. 16*e*, the $Q_{max}$ for the RCNF sample was greater than that of cotton, revealing a higher instant cool feeling can be generated when touching the RCNF. The observed increase in $Q_{max}$ for RCNF could result from the tested material's surface roughness. As seen in FIGS. 18*a* and 18*b*, the RCNF has a smoother surface compared to cotton. These findings are consistent with recent research, revealing a substantial correlation between $Q_{max}$ and fabric surface roughness.

Figure 16F:
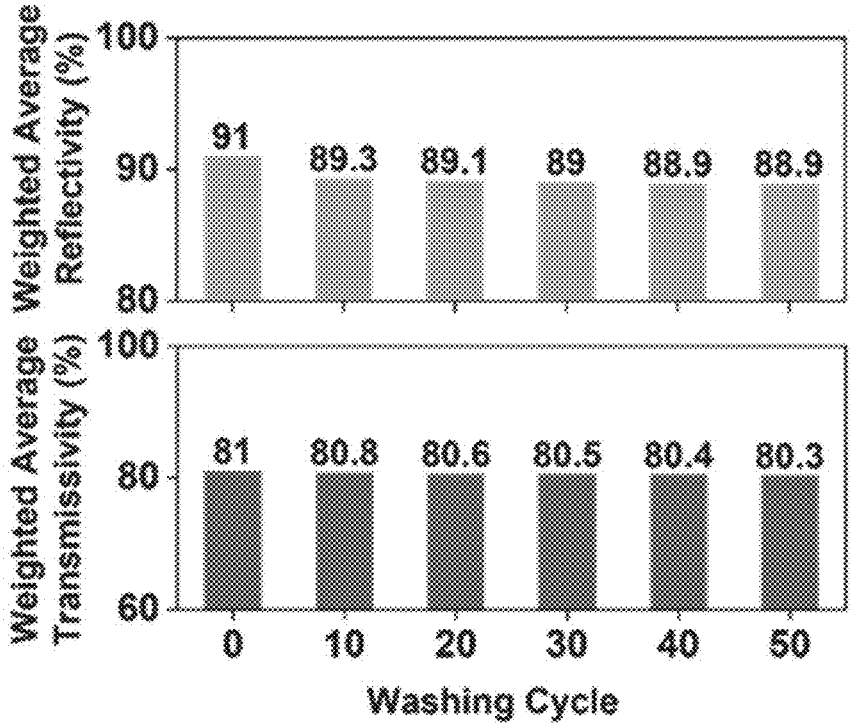
FIG. 16*f* shows solar reflectivity and mid-infrared transmissivity of the RCNF over 50 washing cycles.
Figure 19:
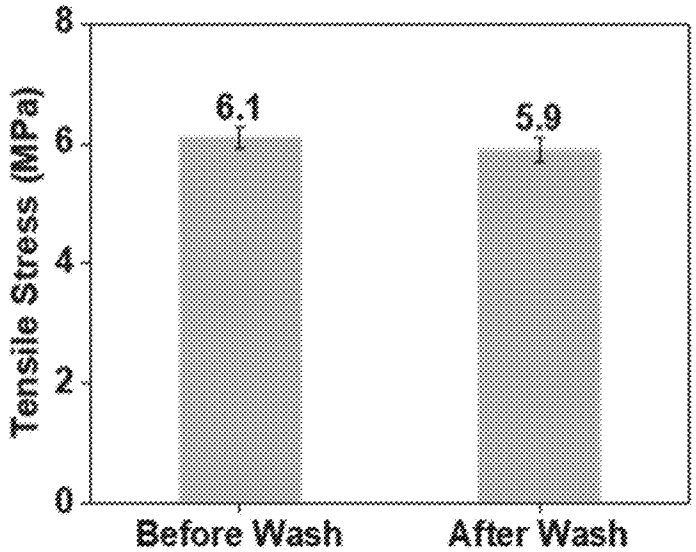
FIG. 19 shows a tensile stress of RCNF before and after washing.

The durability of the RCNF was also determined by measuring weighted average mid-infrared transmissivity and solar reflectivity change of the fabric over 50 cycles of washing. It should be noted that washing might remove some of the ZnO that may be loosely adhered to the surface of PE. From FIG. 16*f*, it can be seen that the solar reflectivity of RCNF before and after 50 washes was close with values between 88.9% and 91%, indicating a very small effect of washing on durability of RCNF. This result may be explained by the fact that as the majority of ZnO particles are embedded in the PE, the solar reflectance of RCNF is essentially the same after washing 50 times. FIG. 16*f* also presents the weighted average mid-infrared transmissivity change of the RCNF after washing 50 times. Before washing, the transmissivity of RCNF is 81%. However, there is no significant change in transmissivity observed after washing over 50 cycles (80.3%). Furthermore, to verify the effect of washing on mechanical properties, the tensile stress of RCNF before and after washing were also measured. From FIG. 19, it can be observed that a 3% reduction in tensile stress occurred due to washing. This could be attributed to the exposure of the RCNF surface to the magnetic stirrer and washing chemicals that could have degraded the RCNF, resulting in a slight decrease of tensile strength. However, it should be noted that even from several washing cycles, the washed RCNF still showed a higher tensile stress than that of the pristine RCNF (i.e. 3.7 MPa) without heat pressing. In short, the durability results illustrate that washing has negligible effect on the as-prepared RCNF in terms of the optical and mechanical performance.

From the above descriptions, one can see that a scalable radiative cooling nano-fabric made of PE fibers and ZnO nanoparticles is developed with outstanding cooling performance using a simple electrospinning technology and post heat-pressing treatment. It is demonstrated that by varying the fibres' diameters and thickness in the fabric, the cooling performance and breathability of the fabric can be regulated. Moreover, the proposed personal cooling nano-fabric, which has an efficient photonic structure, reflects around 91% of solar irradiance (0.25-2.5 μm), and transmits around 81% mid-infrared (8-13 μm) human body radiation to the cold universe. Most importantly, in late October 2021, a demonstration in Hong Kong showed a zero-cooling demand and a temperature drop of simulated skin covered by the RCNF of 9° C. under direct sunlight compared that covered by traditional cotton textile. Similar cooling demand can also be achieved considering various external typical weather conditions. Overall, the prepared textile has outstanding wearability, thermal conductivity and durability compared with the cotton textile, showing excellent potential for applications of smart textiles for human body cooling and energy saving.

Physical Testing Setup

An accurate thickness gauge was used to determine the thickness of a sample manufactured using the method including Steps 50-66. Scanning electron microscopy (JSM-6510LV, 20 kV) was used to determine the microstructure of the RCNF and cotton, and a commercial digital camera was used to record the RCNF appearance. Before the SEM observations, it should be noted that all the samples were gold coated to improve electrical conductivity. The diameter of the nanofiber, and pore size of the RCNF and cotton were measured using Image J software. The mean of twenty samples tested under identical conditions was reported for diameter and pore size determination. The tensile property of RCNF and cotton was tested using an Instron 5566 tensile testing machine with gauge length of 20 mm, tensile rate of 50 mm/min, and sample size of 50 mm×20 mm. The mean of three samples tested under identical conditions was reported for mechanical testing. The low-stress mechanical properties, bending, and surface roughness were measured using a standard fabric objective Kawabata Evaluation System of Fabric (KESF). In brief, a KES-FB 2 bending tester and KES-FB 4 surface tester with a sample size of 200 mm×200 mm were used for bending stiffness and surface roughness measurement, respectively. Three samples were tested under the same conditions and their mean were reported for the low stress mechanical testing.

Optical and Cooling Performance Measurements Setup

The mid-infrared transmissivity of RCNF and cotton was determined using a Fourier transform infrared spectrometer (PIKE Technologies) equipped with a gold integrating sphere for measuring the mid-infrared transmissivity in the 8-13 μm range. An UV-Vis-NIR spectrometer (PE Lambda 1050+, Perkin Elmer) equipped with a diffused integrating sphere was also used to detect the solar reflectance in the 0.25-2.5 μm range. Cooling performance tests were conducted on an open roof area in late October 2021 at the City University of Hong Kong at 22° 200 15.30' N, 114° 100 17.40' E. RCNF and cotton samples (i.e. 5 cm×5 cm) were used to identify the cooling power. To measure the cooling power, the samples were placed on a silicon heater mat. The heater mats were supplied with identical heating power (~104 W/m$^2$) to simulate human body heat generation. One heater mat was left uncovered for simulated bare skin temperature measurement. The samples, along with the heater arrangement, were placed in a shallow hole on top of an expanded polystyrene foam box with a dimension of 30 cm×30 cm×30 cm to obstruct thermal influences from the surroundings. Calibrated T-type thermocouples (123-6312, RS, ±0.3° C. uncertainty) were attached to the surface of the heater to measure the simulated skin temperature. At the same time, a data acquisition system (NI9213, NI9201, CDAQ-9174, National Instruments) was used for data logging. A weather station (YG-BX, YIGU) was located near the setup to measure environmental conditions, including ambient temperature (±0.3° C. uncertainty), humidity (±3% uncertainty), local solar irradiation (±0.2% uncertainty), and wind speed (±0.3 m/s uncertainty).

Wearability Test

Air permeability was measured with an air permeability instrument (SDL Atlas) with a 1 cm 2 head area. To check the stability of the RCNF and cotton in terms of permeability, different pressure drops (50, 100, 150, and 200 Pa) were explored during the test, and their average value was reported. Based on the American Society for Testing and Materials (ASTM E96-80B) standard, the water vapour transmission rate (WVTR) of the RCNF and cotton was calculated by experimentally measuring the quantity of water vapour that can pass through a textile during a specified time. A temperature and humidity-controlled chamber (Model-TH-TG) was used to determine the WVTR of RCNF and cotton under a test condition of 30° C. and 65% RH. In detail, a 100 mL empty cup was filled with 50 mL distilled water, and the cup then covered by the samples and sealed using a gasket. Subsequently, the whole cup was then weighted using a weight balance. During the natural evaporation process, water vapour formed from the water inside the cup passed through the samples and out of the cup. As a result, the reading of the weight balance decreased against time. The WVTR evaluated by G/tA, where G is the weight of the transmitted water vapour (g) determined by the weight difference of the whole cup before and after evaporation, t is the time during which G occurred (hrs), and A is the area of the fabric (m$^2$). On the other hand, the water evaporation rate of RCNF and cotton were evaluated based on GB/T 21655.1-2008. 0.2 g of deionized water was deposited on the fabric (i.e. 50 mm×50 mm), and the weight change was recorded every 300 s. To examine the surface wettability of RCNF and cotton, the static contact angle was evaluated using a contact angle assessing device (SINDIN, SDC-100). Each sample was placed on top of a slide glass and a deionized water droplet with a volume of 0.2 mL was dropped from 1 cm above the sample. The contact angle was quantified 1 s after the droplet touched the surface. The final static contact angle was obtained by repeating this process three times at different locations and calculating the average value.

Conductive heat loss and Warm/Cool sensation ($Q_{max}$) of RCNF and cotton was measured using KES-F7 Thermo Labo II instrument (Kato Tech. Co., Ltd., Japan) at ambient conditions of approximately 21° C. and 65% RH. The KES-F7 Thermo Labo II works on the two-plate approach with a guarded heater to confirm that heat travels only via the tested fabric. To measure the conductive heat loss, a fabric sample (25 cm 2) was placed on a cold plate attached to a water box with a temperature of 20° C. at room temperature. Next, the temperature-controlled hot plate (BT Box) with a temperature of 30° C. was placed over the fabric sample. The conductive heat flux from the BT Box is displayed on the panel once the steady-state condition is achieved. The conductive heat loss is calculated by Q/A, where Q is the conductive heat flux (W) and A is the area of the fabric ($m^2$). For the "$Q_{max}$" value (peak heat flux) measurement on the KES-F7 Thermo Labo II, an additional copper plate (T-box), thermally insulated on all sides, except the face side, was used. The T-box was heated to around 30° C. by placing it over the hot BT-Box. The T-box was then immediately placed over the fabric, which was held over a cold plate (water box) with a constant temperature of 20° C. The maximum heat flux flowing between the T-Box and the fabric surface was detected by the instrument to calculate $Q_{max}$ value of the fabric sample.

The durability of RCNF and cotton was assessed using the American Association of Textile Chemists and Colourists (AATCC 61(1A)-2001) standard wash durability test. Specifically, the sample (about 5 g) with a magnetic stirrer was placed in a beaker containing 100 mL of aqueous detergent solution (approximately 2 mg/mL). The spinning speed and wash duration were set to 500 revolutions per minute and 45 minutes, respectively. The RCNF samples were then cleansed with distilled water to remove any remaining detergent. To investigate the stability of the ZnO nanoparticles embedded in PE, the washing test was repeated 50 times.

The exemplary embodiments are thus fully described. Although the description referred to particular embodiments, it will be clear to one skilled in the art that the invention may be practiced with variation of these specific details. Hence this invention should not be construed as limited to the embodiments set forth herein.

While the embodiments have been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the preferred embodiments described above, the metal oxide in the composition of the ceramic includes $Al_2O_3$, $TiO_2$ and ZnO. The invention is not limited to the use of these specific metal oxide. Rather, any other metal oxide that has a high reflective characteristic may be used for the ceramic material. Similarly, for the preparation of the organic solution, HDPE was used in the exemplary embodiment, but the invention is not limited as such. For example, other types of thermoplastic polymer (e.g., Polyethylene, Polypropylene, etc.) can also be used.

What is claimed is:

1. A method for manufacturing a radiative cooling textile, comprising the steps of:

a) providing an organic solution containing a polymer;

b) adding a metal oxide into the organic solution to form a suspension;

c) electrospinning the suspension on a substrate to form an electrospun fabric of nanofibers; and d) performing a heat-pressing treatment to the electrospun fabric thereby subjecting nanofibers in the electrospun fabric to inter-fiber fusion and bonding;

wherein an average diameter of the nanofibers is about 0.45 μm, and the thickness of the radiative cooling textile is about 85 μm.

2. The method of claim 1, wherein Step c) further comprises the steps:

e) feeding the suspension into a syringe; and f) spinning the suspension by a syringe pump at a spinning voltage.

3. The method of claim 1, wherein the spinning voltage is 25 kV.

4. The method of claim 1, further comprises the step of drying the electrospun fabric before Step d).

5. The method of claim 1, wherein Step a) further comprises dissolving the polymer in the organic solution, and then stirring the organic solution using a magnetic stirrer.

6. The method of claim 1, further comprises after Step b) the step of stirring the suspension until particles of the metal oxide are evenly dispersed without obvious agglomeration.

7. The method of claim 1, wherein the substrate is an aluminum foil.

8. The method of claim 1, wherein in Step d) applied pressure, temperature and time are 0.14 MPa, 105° C. and 30 minutes, respectively.

9. The method of claim 1, wherein in Step d) the heat-pressing is conducted in two sides of the electrospun fabric.

10. The method of claim 1, wherein the metal oxide is reflective and the polymer is thermoplastic.

11. The method of claim 1, wherein the metal oxide is zinc oxide and the polymer is polyethylene.

12. The method of claim 1, wherein the inter-fiber fusion and bonding is induced by melting part of the polymer between the nanofibers.

13. The method of claim 1, further comprises, before Step b) and after Step a), the step of heating the organic solution to 120°.

* * * * *